US006642893B1

(12) United States Patent
Hebron et al.

(10) Patent No.: US 6,642,893 B1
(45) Date of Patent: Nov. 4, 2003

(54) MULTI-BAND ANTENNA SYSTEM INCLUDING A RETRACTABLE ANTENNA AND A MEANDER ANTENNA

(75) Inventors: Ted Hebron, Lincoln, NE (US); Willis R. Hardy, York, NE (US); Govind R. Kadambi, Lincoln, NE (US); Ying Dong Song, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/142,542

(22) Filed: May 9, 2002

(51) Int. Cl.[7] ..... H01Q 1/24

(52) U.S. Cl. ..... 343/702; 343/725; 343/895; 343/867

(58) Field of Search ..... 343/700 MS, 702, 343/725, 726, 729, 742, 895, 867; H01Q 1/24, 1/36

(56) References Cited

U.S. PATENT DOCUMENTS 5,559,524 A 9/1996 Takei et al.
5,892,483 A * 4/1999 Hayes et al. ..... 343/729
6,031,496 A 2/2000 Kuittinen et al.
6,069,592 A 5/2000 Wass
6,342,859 B1 * 1/2002 Kurz et al. ..... 343/702
6,351,241 B1 2/2002 Wass
6,380,900 B1 * 4/2002 Kanayama ..... 343/702
6,424,302 B1 * 7/2002 Wu ..... 343/702
6,459,413 B1 * 10/2002 Tseng et al. ..... 343/702
6,563,476 B1 * 5/2003 Sheng-Gen et al. ..... 343/895

* cited by examiner

*Primary Examiner*—Tho Phan
(74) *Attorney, Agent, or Firm*—Holland & Hart

(57) ABSTRACT

A multi-band antenna including a retractable antenna and a meander antenna wherein the meander antenna may take several forms. In all of the embodiments, the meander antenna comprises first and second meander radiating elements. In one form of the invention, the closed ends of the loops of the second meander radiating element protrude into the open ends of the loops of the first meander radiating element. In other forms of the invention, active and/or passive elements are positioned between the first and second meander radiating elements. In some forms of the invention, the active or passive elements include stubs which protrude into the open ends of the loops of the first meander radiating element.

59 Claims, 20 Drawing Sheets

MULTI-BAND ANTENNA SYSTEM INCLUDING A RETRACTABLE ANTENNA AND A MEANDER ANTENNA

BACKGROUND OF THE INVENTION

1. Field of the Invention

The present invention relates to a multi-band antenna system including a retractable whip antenna and a meander antenna having a plurality of selectively coupled meander radiating elements formed on a dielectric flexible board. The meander antenna may include one or more passive elements which may be selectively coupled to the meander radiating elements of the meander antenna.

2. Description of the Related Art and the Relationship of the Instant Invention Thereto In the rapidly evolving technology of cellular communication, there is an emerging thrust on the design of multi-purpose cellular handsets. A cellular handset which has system capabilities of both dual cellular and non-cellular (such as GPS) applications has become a new feature. Thus, there is a growing trend to design antennas which operate in both the dual cellular and non-cellular frequency bands. The inherent problem facing such a design is the bandwidth requirement at the upper resonance of the antenna to simultaneously cover both the GPS band (1575 MHz) and the upper cellular band such as either DCS (1710–1880 MHz) or PCS (1850–1990 MHz). The combined bandwidth requirement to cover the GPS and PCS bands of operation approximates about 23.35%. The easy recourse of an additional antenna with a separate feed to cover the GPS band alone has not proved to be an attractive alternative. In view of this, a single feed multi-band antenna operating both in the dual cellular and non-cellular bands is a topic of considerable importance for cellular applications. The instant invention is a new method of designing a single feed multi-band retractable antenna operating in the dual cellular bands (AMPS/PCS) as well as non-cellular (GPS) band. The significant aspect of this invention pertains to the design of the single feed, multi-element meander antenna as the primary radiator in the retracted position of a multi-band whip antenna. In this invention, a multi-element meander antenna or radiator replaces the conventional helical coil radiator to constitute the primary radiator for the retracted position of a multi-band whip antenna.

A conventional prior art multi-band retractable antenna 100 for a cellular handset 101 is shown in FIGS. 16A and 16B. FIG. 16A illustrates the multi-band retractable antenna in its retracted position. A plastic housing or sheath 102 fully encloses a helical coil radiator or a meander radiator positioned therein. The plastic housing 102 is usually mounted near one of the corners at the top edge 103 of the handset 101. The plastic housing 102 with a helical coil radiator or meander radiator therein is usually positioned so as to have an outward extension with respect to the top edge 103 of the handset 101. Such a position is conducive for good antenna radiation characteristics. In the retracted position of the multi-band retractable antenna, 100, as depicted in FIG. 16A, the whip antenna 104 with stopper 105 mounted thereon is decoupled from the helical coil radiator or meander radiator positioned within the plastic housing 102. Only the radiator inside the plastic housing 102 is allowed to retain contact with the RF connector 106 placed on the chassis 107 of the handset 101. In the retracted position of the multi-band antenna 100, the helical coil radiator or meander radiator alone is the dominant or primary radiator with an insignificant contribution of the whip antenna 104.

FIG. 16B illustrates the configuration of the prior art multi-band antenna 100 in its extended position. In this configuration, the whip antenna 104 is pulled up and through the connector 106 with the stopper 105 of the whip antenna 104 making contact with the RF connector 106. In the extended position, along with the whip antenna 104, the helical coil radiator or meander radiator positioned within the plastic housing 102 is also connected to the RF connector 106. When the whip antenna 104 is in the extended position, the dominant radiator of the retractable multi-band antenna 100, however, is the linear whip antenna 104 with its length designed at least for the quarter wavelength of operation and extending well above the plastic housing 102. It is of importance to note that the coupling between the whip antenna 104 and the helical coil radiator or meander radiator requires optimization to obtain the desired radiation characteristics of the whip antenna.

In most conventional multi-band retractable antenna designs, the dominant or primary radiator in the retracted mode is usually an ordinary helical coil. With a single coil of simple geometry, realizing a multi-band operation with satisfactory bandwidth imposes the requirement of an external matching network. If the desired frequency bands of operation include more than two bands, e.g. AMPS/GPS/PCS or GSM/GPS/DCS, the design of the helical coil is an involved task. Such a multi-band retractable antenna design may result in a complicated helical coil which is difficult to fabricate. Therefore, the design of a multi-band radiating element which is easy to fabricate is desirable. In the proposed invention, resorting to the meander radiator planar technology, a radiator in the form of a plurality of meander radiating elements is designed and etched on a dielectric flexible board resulting in fabrication ease. Unlike the design of a conventional helical coil, the design of the meander radiator on the flexible board does not impose any constraint on the complexity of the antenna structure from a fabrication point of view. Any arbitrary variations in the profiles of the radiating elements of the meander radiator on the flexible board can be easily and consistently reproduced with relative ease. This is a distinct advantage of the choice of the meander radiator over conventional helical coils as the primary radiator in the retracted position of multi-band retractable antennas.

In the design of a retractable antenna, the input impedance of the whip (wire) antenna (normally of quarter wavelength or more in its length) is different from the desirable 50 ohms. The deviation of the input impedance from the desired nominal impedance of 50 ohms depends mainly on the chosen length for the whip antenna as well as the chassis or associated ground plane of the radio device. To realize the impedance match at the RF input port of the radio or communication device, an external matching circuit with discrete inductors and capacitors is common in most of the prior art designs. Apart from the external matching network for the extended position, a separate and additional external matching network for the impedance match for the radiator in the retracted position may also be needed. Such a necessity arises to obtain the impedance match of the helical coils (which are the dominant radiators in the retracted mode) at the RF input port of the device. Therefore alternate designs of multi-band retractable antennas devoid of either the single or dual external matching networks are of significant importance for cellular communication. This invention proposes the design of multi-band retractable antennas without necessitating the requirements of impedance matching networks either for the extended or the retracted positions. In this invention, the meander radiator is designed for a selfimpedance match in the retracted position. In addition, the meander radiator is also designed to serve the analogous role of an external matching network to realize the impedance match for the whip antenna in the extended position of the multi-band retractable antenna. The proposed invention circumvents the necessity of an external matching network to realize the design of a single feed multi-band retractable antenna whose upper resonant band itself comprises multiple frequency bands with wider separation between them such as GPS/PCS bands.

In the recent past, there is an emerging trend for a closer look at the impedance characteristics of antennas toward optimizing gain performance thereof. The current concept of emphasizing the antenna VSWR, alone, for the satisfactory gain performance is changing. In many antenna designs, the gain performance has greater dependence on the relative magnitudes of the resistive and reactive components of the antenna impedance rather than on the mere magnitude of VSWR alone. Therefore the multi-band antenna designs with versatile means of controlling its impedance characteristics is of special relevance to cellular communication applications.

The choice of the meander radiator as the primary radiator in the retracted position of the proposed multi-band retractable antenna provides the designer additional degrees of freedom hitherto not normally found in the design of conventional retractable antennas with simple helical coils. The present invention proposes several schemes for the design of a single feed multi-band meander radiator either with a combination of active elements only, or, with a combination of active and passive elements. Deviating distinctly from the prior art designs, this invention presents design schemes for the single feed multi-band meander radiator which utilizes the combination of selective coupling and multiple element parasitic effects between active and passive radiators.

U.S. Pat. No. 6,069,592 ("Meander Antenna Device" by Bo Wass of Aligon AB, Sweden) deals with meander antennas for dual or multi-band operation for the retracted position of a whip antenna. Similar to the proposed design of this invention, the radiator for the retracted position of the multi-band whip antenna suggested in the above patent also claims two separate meander radiating elements resonating in the respective lower and upper frequency bands. The distinct difference between the above patent and the proposed invention lies in the relative orientation and configuration of the meander radiating elements for optimizing the performance of the multi-band radiator for the retracted position of the whip antenna. Unlike the patent by Wass, the dual or multiple meander radiating elements of this invention provide for the protrusion of one meander radiating element (designed for a particular resonant band) into the other meander radiating element providing a distinctly different frequency band. Such an intentional protrusion results in the selective coupling between the two meander radiating elements operating in different frequency bands. For the design of a multi-band meander antenna in the retracted position of the whip antenna with only two meander radiating elements, the profiles of the meander radiating elements of this invention are chosen such that the closed loops of one meander radiating element protrude into the open loops of the other meander radiating element resulting in coupling therebetween. For the design of multi-band meander antenna with three elements of this invention, the central element includes the provision for the attachment of coupling stubs to it. The coupling stubs on the central element are designed to protrude into the open loops of an adjacent meander radiating element resulting in selective coupling between different meander radiating elements designed for different resonant frequencies.

Another distinction between the patent by Wass and the proposed invention is in the design of the third (central) element thereof. In Wass' patent pertaining to the design of the multi-band radiator with three elements, the third element is similar to the first and second meander radiating elements, but tuned to a third frequency different than the first and second resonant frequencies. From this, it is clear that the design configuration of Wass has the third meander radiating element connected to the other two meander radiating elements by a common feed line. This in turn implies that the three meander radiating elements of Wass' invention are active elements connected together to a common feed point for multi-band operation. In the proposed design of the multi-band meander antenna with three elements of this invention, there is no such restriction on the third (central) element. This invention proposes a single feed multi-band meander antenna whose configuration can be a combination of active and passive elements as well. In some of the embodiments of this invention, the third (central) element can be a parasitic radiator. Such a parasitic central element is physically isolated from the other adjacent meander radiating elements. Further, unlike the case of Wass' patent, this invention proposes several schemes wherein the third (central) element need not be similar to the other two adjacent elements in its profile or shape. The central element of this invention can be substantially linear as compared to the conventional zigzag profiles of the other two adjacent radiating elements. Unlike the patent by Wass, this invention proposes the design of the combination of a plastic housing which encloses the multi-band meander antenna and the associated metal connector for providing the RF feed path to the antenna as a single, over-molded part. Such a choice improves the cost effectiveness of fabrication and simplifies the integration of the antenna to the radio device.

Some of the design embodiments of a single feed multi-band multi-element meander antenna of this invention also have the advantage of improved cross-polarization performance, which often can be a desirable feature. The significant improvement in the cross-polarized radiation patterns without noticeable degradation of the co-poarized radiation characteristics will improve the cellular antenna performance in its User position.

SUMMARY OF THE INVENTION

This invention proposes several embodiments of providing a single feed multi-band meander antenna or radiator with dual and multiple elements as the primary radiator for the retracted position of the multi-band retractable antenna. The design of the multi-band meander radiator of this invention as a radiator for the retracted position of whip antenna accomplishes the requisite bandwidth for tri-band (AMPS/PCS/GPS) performance without the need for an external matching network. The absence of the requirement of an external matching network is valid for both the extended and retracted positions of the multi-band whip antenna while still maintaining the tri-band operation of AMPS/PCS/GPS bands. The dual or multiple radiating elements of the meander radiator of this invention permit the protrusion of one meander radiating element (designed for a particular resonant band) into the other meander radiating element supporting a distinctly different frequency band. Such an intentional protrusion results in the selective coupling between the two meander radiating elements operating in different frequency bands. To characterize the bandwidth and gain performance with varying structural modifications, the design of the central radiating element with and without coupling stubs is also described. In particular, the coupling stubs of the central element protrude into the open loops of the meander radiating element designed for the resonant lower band. The effect of varying the position of the contact point of the central element on a line that is common to the other two adjacent meander radiating elements is also provided for in this invention. In another embodiment of this invention, instead of the central element making a direct physical contact with the other meander radiating elements placed on either side of the central element, the (third) central meander element is designed to have physical separation from the adjacent meander radiating elements leading to its functioning as a parasitic element. Such a central element of a parasitic nature is designed with or without the above-referred coupling stubs protruding into the open loops of the meander antenna designed for lower resonant band. The relative merits for the choice of the central radiating element either as an active element or passive (parasitic) element have also been addressed in this invention. The advantages of having a design variation in the shape of the central parasitic element (either Inverted L-shape or Inverted U-shape) have also been studied in this invention.

In the first embodiment of this invention, a design of the multi-band meander antenna 10 (with only two radiating elements) as a primary radiator for the retracted position of the whip antenna, the profiles of the meander radiating elements are chosen such that the closed loop of one meander radiating element (designed for a resonant frequency) directly protrude into the open loop of the other meander radiating element (designed for a different resonant frequency) resulting in selective coupling between them. The realizable selective coupling can be optimized to control/improve the overall bandwidth and radiation performance in the extended and retracted positions of the multi-band whip antenna. In the second embodiment of this invention dealing with the design of multi-band meander antenna 20 with three elements, the central element includes coupling stubs. The coupling stubs are designed to protrude into the open loops of an adjacent meander radiating element resulting in selective coupling between different meander radiating elements. The variation in the selective coupling is determined by the location of the coupling stubs on the central element, the shape of the coupling stubs and the extent of the protrusions of the coupling stubs into the open loops of the adjacent meander radiating element designed for a different resonant frequency.

In the second embodiment, the conjuncture point connecting the third (central) element to the other elements is in close proximity to the open loops of the meander radiating element designed for the upper resonant frequency. In the third embodiment of this invention dealing with the design of single feed multi-band meander antenna 30 with three elements, the common (conjuncture) point connecting the third (central) element to the other two elements is positioned nearer to the open loops of the meander radiating element designed for the lower resonant frequency. A relative comparison between the results of the second and third embodiments of this invention illustrates the effect of the relative proximity of the conjuncture point of the third element to the open loops of the other radiating elements.

In the fourth embodiment of this invention, the design configuration of the single feed multi-band meander antenna 40 involves the combination of active and passive elements. Unlike the second and third embodiments of this invention, the third or central element is designed as a passive radiator to serve as a parasitic to the adjacent active meander radiating elements designed for the lower and upper resonant frequencies of interest. The central element having an inverted U-shape is physically isolated from the other two adjacent meander radiating elements. The central element having an inverted U-shape has the coupling stubs protruding into the open loops of the meander radiating element designed for lower resonant frequency of multi-band operation. The fourth embodiment of this invention demonstrates the possibility of invoking the combination active and passive elements in the design of single feed multi-band meander radiating element with satisfactory bandwidth to cover (AMPS/GPS/PCS) bands. A comparative study of the results of the second and third embodiments with that of the fourth embodiment of this invention illustrates the effect of the choice of the active or passive third element on the resonant and gain characteristics of the multi-band meander radiating element.

The single feed multi-band meander antenna 50 of the fifth embodiment of this invention differs from the fourth embodiment in the shape of the third (central) element acting as a parasitic element to the other radiating elements. In this embodiment also, the third element is designed to be a passive radiator to act as a parasitic element. Instead of an inverted U-shape as in the fourth embodiment, the third element of the fifth embodiment of this invention has the shape of an inverted L-shape. The central element of inverted L-shape has coupling stubs protruding therefrom into the open loops of the meander radiating element designed for lower resonant frequency of multi-band operation. The influence of the shape of the passive third element on the bandwidth and the radiation performance of the multi-band meander radiating element can be inferred through a comparative study of the results of the fourth and the fifth embodiments of this invention.

The single feed multi-band meander antenna 60 of the sixth embodiment of this invention differs from the meander antenna 50 of the fifth embodiment in the configuration of the third (central) element acting as a parasitic element to the other radiating elements which are designed for the resonance at the lower and upper cellular bands. In the sixth embodiment of this invention also, the third element is configured as a passive element and functions as a parasitic element to the other radiating elements. The absence of the coupling stubs on the parasitic central element of meander antenna 60 of the sixth embodiment of this invention distinguishes it from the meander antenna 50 referred in the fifth embodiment. The relative comparison of the results of fifth and the sixth embodiments of this invention offers an insight into the influence of the coupling stubs of the parasitic central element on the bandwidth as well as the radiation characteristics of the multi-band meander antennas 50.

The meander antenna 70 of the seventh embodiment of this invention differs from the meander antenna 60 of the sixth embodiment in the shapes of the parasitic third (central) element. The parasitic third element of the meander antenna 70 is of an inverted U-shape instead of an inverted L-shape as in meander antenna 60. The comparative study of the results of the sixth and the seventh embodiments of this invention enables to characterize of influence of the shape of the third element (without coupling stubs) on the bandwidth and the radiation characteristics of the multi-band meander antennas 60 and 70.

The design embodiments of the single feed multi-band meander antennas of this invention for the retracted position of the whip antenna have the advantage of compactness and fabrication ease. The planar technology of meander antennas of this invention also has the advantage of improved production tolerance resulting in reduction of rejection rate. All the multiple elements of the proposed multi-band meander antenna can be formed in a single process of etching or printing. Therefore the proposed multi-band meander antenna with multiple elements formed on flexible board of this invention is amenable for large-scale production and is cost-effective to manufacture. The design of the single feed multi-band multi-element meander antenna of this invention is versatile and has a greater degree of freedom to control its impedance characteristics. Many design options yielding almost the same results are possible with the proposed design. In view of the emerging demand of a single antenna for the cellular handset with multi systems application capabilities, this invention has a greater emphasis on the design of multi-band retractable antenna for tri-band operation comprising the AMPS band (cellular) for its lower resonance and the combined PCS (cellular) and GPS (non-cellular) band for its upper resonance. This invention also accomplishes the realization of adequate bandwidth of the multi-band retractable antenna comprising the whip antenna and the multi-element meander antenna without resorting to either single or dual external impedance matching networks. The gain performance of the multi-band meander antennas proposed in this invention is better than that is usually associated with the conventional helical coil design.

One of the principal objectives of this invention is to provide a single feed multi-band meander antenna for the retracted position of the whip antenna to cover dual cellular and non-cellular frequency bands. Specifically, one of the primary objectives of this invention is to provide a single feed multi-element meander antenna for multi-frequency operation whose upper resonance comprises the two frequency bands with wider separation between them.

Another objective of this invention is to provide a design scheme for realizing the satisfactory bandwidth of a multi-band retractable antenna devoid of external impedance matching networks in both its extended and retracted positions.

Another objective of this invention is to provide a design scheme for single feed multi-band retractable antennas with better and increased provisions to control the impedance characteristics thereof.

A further objective of this invention is to provide a multi-band meander antenna or radiator as a retracted position radiator with a desirable feature of improving or controlling the cross-polarization performance of the retractable antenna.

An objective of this invention is also to characterize the performance of a single feed multi-band multi-element meander antenna whose configuration consists of a combination of active and passive elements One of the objectives of this invention is the shape optimization of the active or passive central element of a single feed multi-band multi-element meander antenna to improve the overall performance of the retractable antenna in its retracted and extended positions.

Yet another objective of this invention is to provide a single feed multi-element multi-band meander antenna or radiator, for the retracted position, that takes advantage of features for structural simplicity, compactness of size and fabrication ease toward high volume manufacturing.

An important objective of this invention is to provide the combination of a plastic housing encompassing the multi-element multi-band meander antenna as well as the associated RF connector as a single over-molded part to simplify and enhance the ease of antenna integration to the communication device.

These and other objectives will be apparent to those skilled in this art.

DESCRIPTION OF THE PREFERRED EMBODIMENTS

Figure 16A:
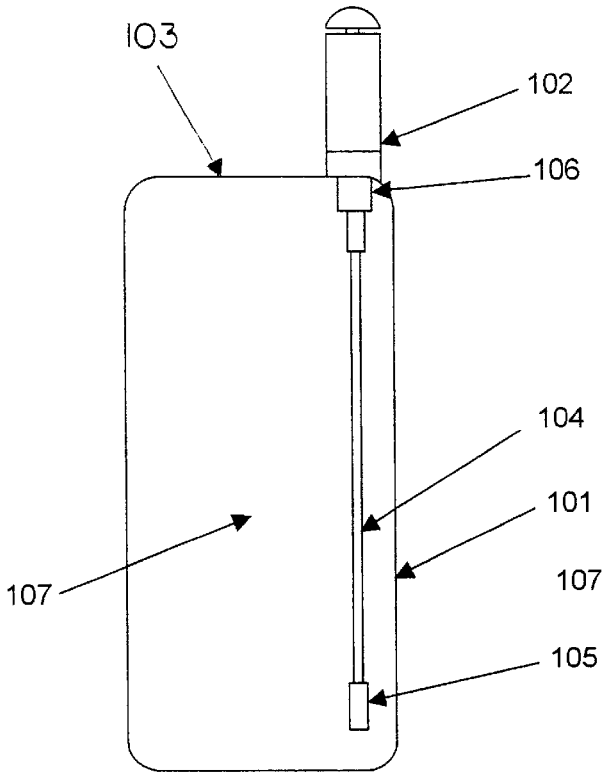
FIG. 16A (PRIOR ART)
FIG. 16A is a schematic diagram of the retracted position of a conventional prior art whip antenna with the helical coil or meander antenna inside a plastic housing.
Figure 16B:
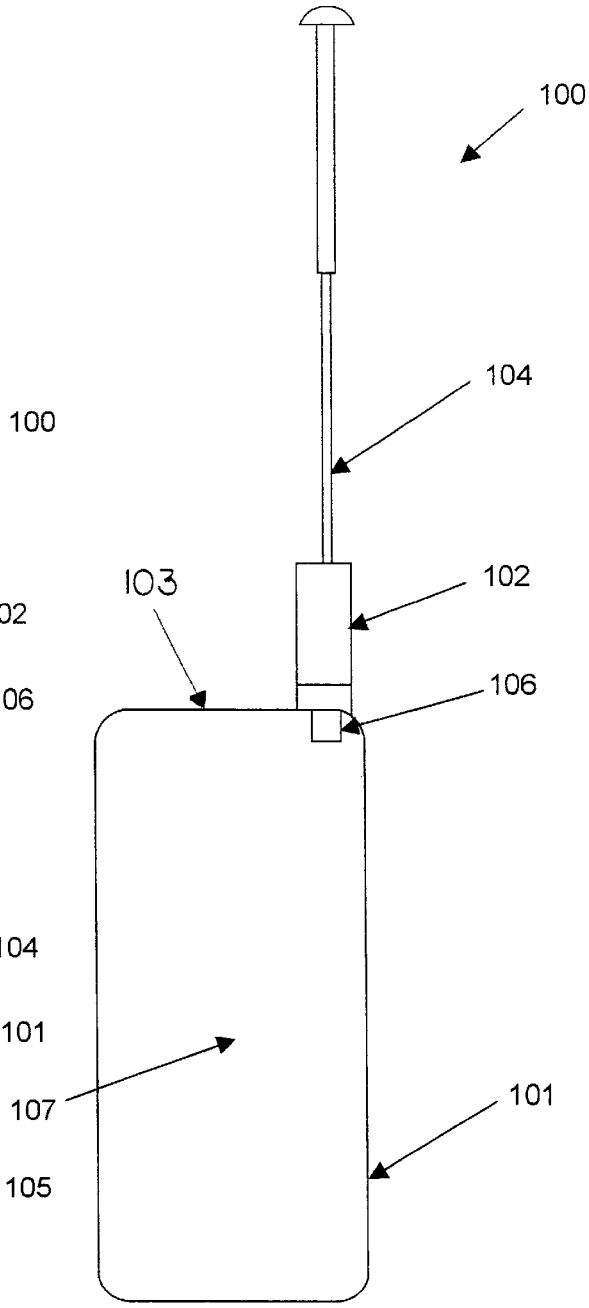
FIG. 16B (PRIOR ART)
FIG. 16B is a schematic diagram of the extended position of a conventional prior art retractable antenna with the helical coil or meander antenna inside a plastic housing.

In all the designs of conventional prior art retractable antennas for a cellular handset, the helical coils forming the dominant radiator when the retractable antenna is in the retracted position are invariably placed in a dielectric housing or sheath having a cylindrical shape, as shown in FIG. 16. This dielectric housing is usually located near one of the corners at the upper end of the cellular handset. Such a placement of the plastic housing enclosing the radiating element (helical coil) is elegant and efficient from a performance point of view. The radius and the number of turns of the helical coils are designed to yield satisfactory performance without resulting in an excessively longer or a wider plastic housing. This in turn ensures that the overall length of the cellular handset is still reasonably compact despite a protruding plastic housing at one of its corners at the upper end thereof. It is desirable that the proposed design of the meander antenna of this invention which replaces the conventional coils of a multi-band retractable antenna also utilizes the similar plastic housing designed previously for the coils.

For non-cellular communication applications, the prior art meander radiating elements are usually formed on a flat substrate, which is not flexible. In order to utilize the above-referred protruding plastic housing (generally, but not limited to, of circular cylindrical shape) designed for the retractable antenna with a helical coil, the multi-band meander antenna for the retracted position of the whip antenna of this invention should also have the adaptability for its placement within the same plastic housing. Therefore, the multi-band meander antennas of this invention are designed and formed on a flexible dielectric substrate (flex or flexible board). The meander antennas formed on the flex board are wrapped around a dielectric spacer of circular cylindrical shape with a pre-desired radius and dielectric constant to facilitate its placement within the plastic housing.

Preferred embodiments of the present invention are now explained while referring to the drawings.

Figure 1:
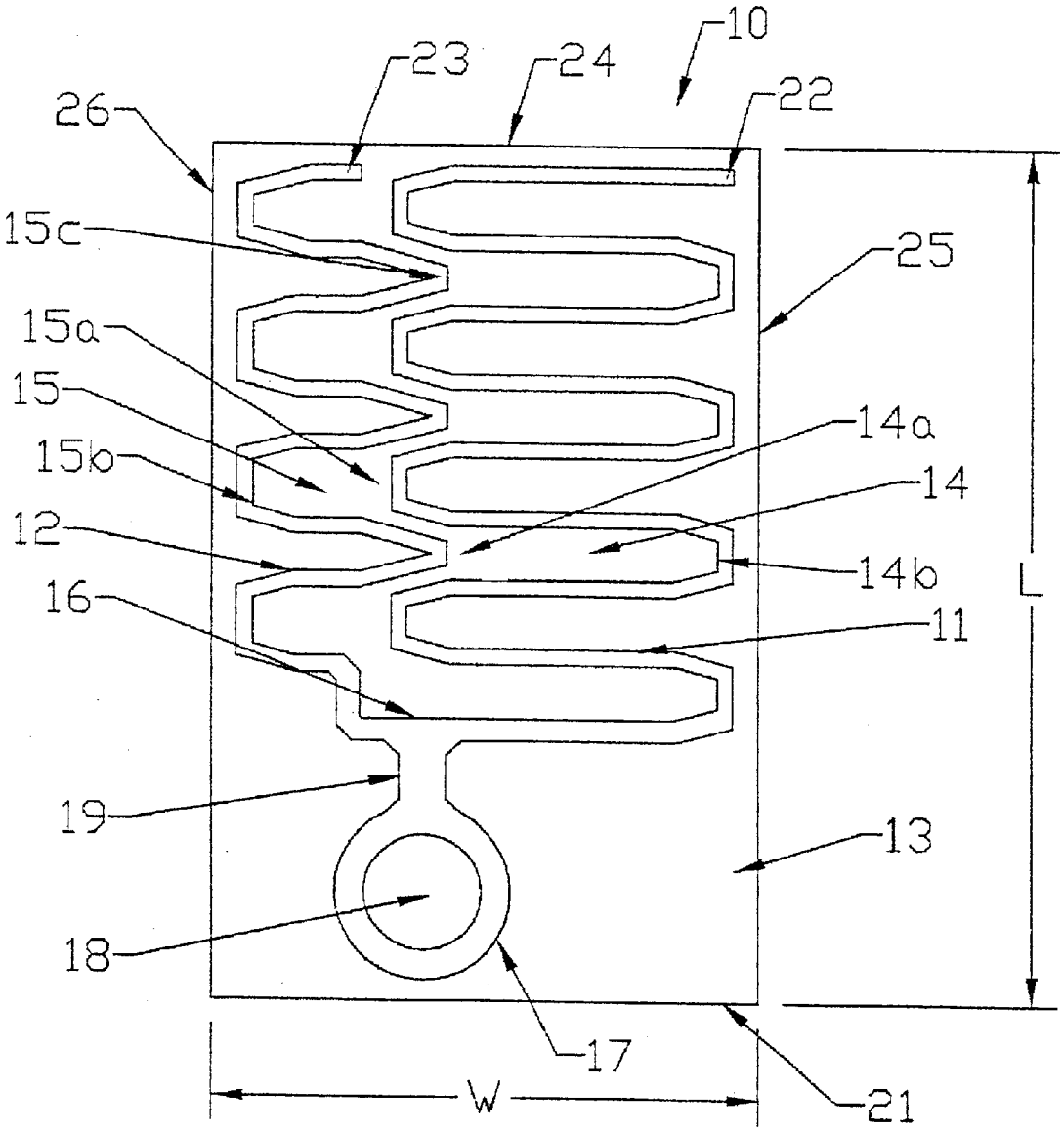
FIG. 1 is a plan view of the design configuration of a single feed multi-band meander antenna 10 with two active elements according to the first embodiment of this invention.

The first embodiment of this invention is a single feed multi-band meander antenna 10 having two meander radiating elements which will be operative when the whip antenna is in its retracted position. The meander antenna 10 of this embodiment consists of two active elements. In the first embodiment of this invention (FIG. 1), meander antenna 10 comprises two meander radiating elements 11 and 12 formed on a flex board 13 having pre-determined dielectric properties. The radiating element 11 has a number of turns or loops 14 having substantially a rectangular shape. The radiating element 11 is initially designed for the lower resonant frequency of multi-band operation. Each of the loops 14 has an open end 14*a* and a closed end 14*b*. The number of loops 14, the width of the loop 14, the height of the closed end 14*b* as well as the dielectric constant of the flex board 13 are the primary parameters which determine the resonant frequency as well as the bandwidth of the radiating element 11. The radiating element 12 also has a number of turns or loops 15 having a tapered cross-sectional area. The radiating element 12 is initially designed for the upper resonant frequency of multi-band operation. Each of the loops 15 also has an open end 15*a* and a closed end 15*b*. The two radiating elements 11 and 12 are joined together at 16. A common feed tab 17 of circular ring-like structure with a central hole 18 formed therein is attached to the radiating elements 11 and 12 through a common leg 19. The common leg 19 of the feed tab 17 is attached to the radiating elements 11 and 12 at 16. The feed tab 17 is in close proximity to the lower edge 21 of the flex board 13. The free ends 22 and 23 of the radiating elements 11 and 12 are located near the top edge 24 of the flex board 13. The tapered ends 15*c* of the loop 15 of the radiating element 12 are designed for their selective protrusion into the open ends 14*a* of loops 14 of the radiating element 11. The above-mentioned selective protrusions of the tapered ends 15*c* of the element 12 into the open loops 14*a* of the element 11 facilitate a conditional (selective) coupling between the two radiating elements 11 and 12 operating at the lower and upper resonant bands of interest. In the absence of such a conditional (selective) coupling, the resonant frequency as well as the bandwidth of the radiating element 11 (designed for the lower resonant band of multi-band operation) are determined by: the number of loops 14, the width of the loop 14, the height of the closed end 14*b*, the position of the common leg 19 of the feed tab 17, as well as the dielectric constant of the flex board 13. Likewise, in the absence of conditional coupling, the resonant frequency as well as the bandwidth of the radiating element 12 (designed for the upper resonant band of multi-band operation) are determined by: the number of loops 15, the width of the loop 15, the height of the closed end 15*b*, the position of the common leg 19 of the feed tab 17 as well as the dielectric constant of the flex board 13. Because of the conditional or selective coupling as a result of the protrusion of a segment of a radiating element 12 into the segment of a radiating element 11, there is an interaction between the radiating elements 11 and 12. Because of this interaction, the resonant frequencies and the bandwidths of the two radiating elements 11 and 12 initially designed for the lower and upper resonant bands are no longer independent of each other. The coupling between the two elements 11 and 12 because of a common feed point 16 is also an additional parameter that determines the resonant frequencies and the bandwidth of the two elements 11 and 12. The interaction between the two radiating elements 11 and 12 because of the above-referred conditional or selective coupling can be optimized for the improved performance of the multi-band antenna by the proper choice of the combination of geometrical parameters of the radiating elements 11 and 12 such as the width of the loops 14 and 15, the number of loops 14 and 15 of the radiating elements 11 and 12 as well as the extent of protrusions of the tapered ends 15*c* of loop 15 (of radiating element 12) into the open end 14*a* of loop 14 (of radiating element 11). A combination of the above parameters determining the selective coupling (interaction) can be discretely varied to control the bandwidth at the lower and upper resonant bands of the meander antenna 10. The proposed concept of the design of meander antenna 10 with two elements has been implemented in the development of a single feed multi-band (AMPS/PCS/GPS) radiator for the retracted position of the whip antenna. In the development of the proposed multi-band meander antenna 10, the upper resonance of the antenna comprises a combination of the cellular (PCS) and the non-cellular (GPS) bands. The meander antenna 10 developed as proposed in the first embodiment of this invention has the satisfactory gain and bandwidth to cover the lower resonant band (AMPS) and the upper resonant band comprising GPS and PCS. The requisite bandwidth for the tri-band operation of the meander antenna 10 is realized without the necessity of an impedance matching network. The novel design feature of the meander antenna 10 of this invention is the realization of extended frequency range of its upper resonance to include the two individual bands with wider separation between them.

Figure 2:
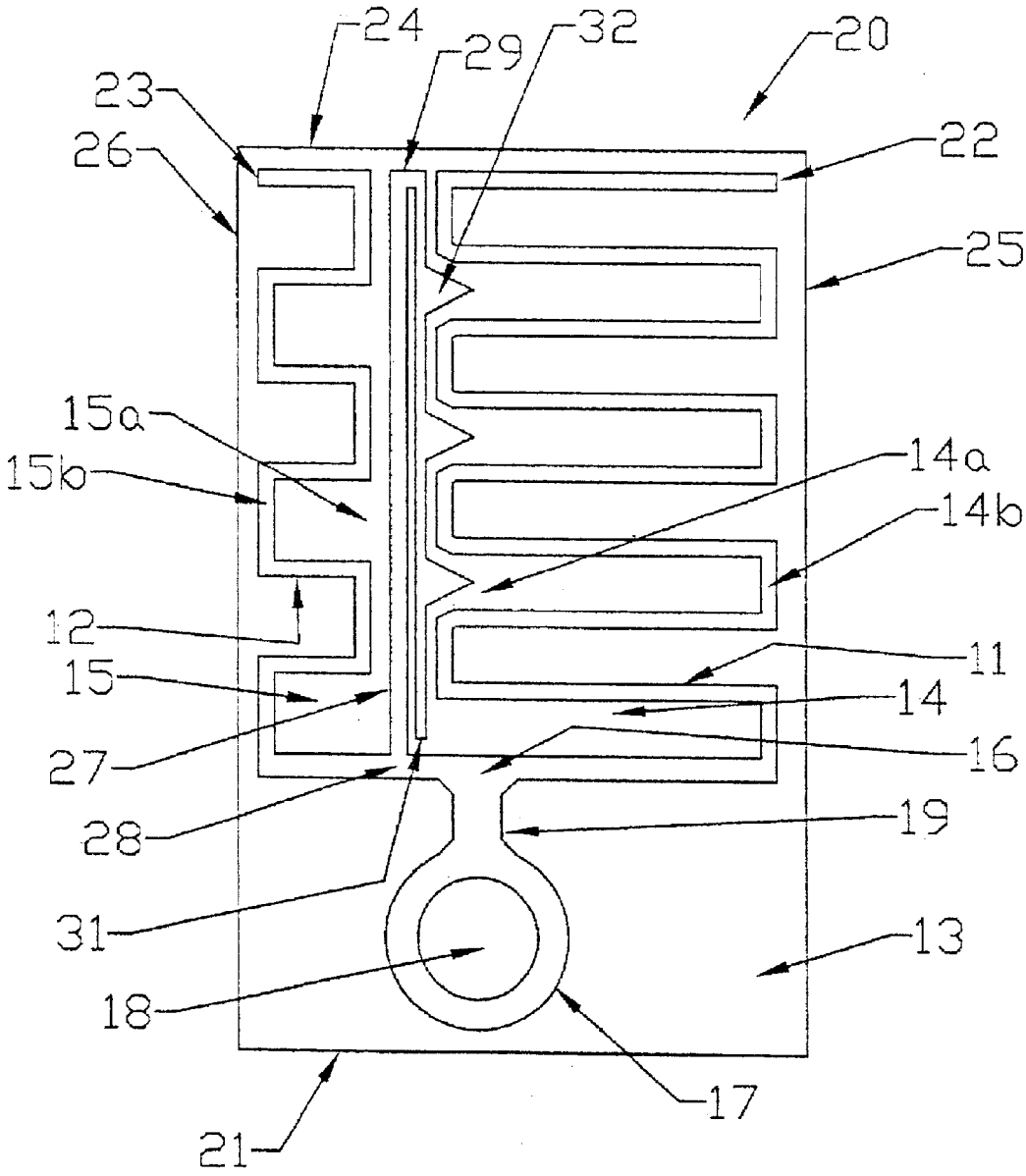
FIG. 2 is a plan view of the design configuration of a single feed multi-band meander antenna 20 with three active elements according to the second embodiment of this invention.

The second embodiment of this invention is a single feed, multi-band meander antenna 20 with three radiating elements which will be operative when the whip antenna is in its retracted position. In the second embodiment of this invention (FIG. 2), the meander antenna 20 consists of three meander radiating elements. The radiating element 11 is initially designed for its resonant frequency at the lower band of multi-band operation. Likewise, the radiating element 12 is initially designed for its resonant frequency at the upper resonant band of multi-band operation. Both the radiating elements 11 and 12 are substantially of rectangular shapes, as seen in FIG. 2. Unlike elements 11 and 12, the third linear radiating element 27 is devoid of loops. The radiating element 27 is attached to the other two radiating elements 11 and 12 at 28. The radiating element 27 is then bent at 29 (near the top end 24 of the flex board 13) to form an inverted U-shape. The free end 31 of the radiating element 27 is in close proximity to the loop 14 of the radiating element 11. The length of the radiating element 27 between 28 and 29 is referred to as the closed section of the element 27. The open section of the radiating element 27 refers to the length of the element 27 between 29 and 31. The length of the radiating element 27 is designed for the resonant frequency in the vicinity of upper cellular band of the multi-band operation. The open section of the radiating element 27 that is relatively closer to the radiating element 11 has triangular-shaped coupling stubs 32. The coupling stubs 32 are designed to protrude into the open ends 14*a* of loops 14 of the radiating element 11. The size of the triangular stubs 32 is chosen so as to allow their free passage into the open ends 14*a* of loops 14 of the radiating element 11 without making a contact therewith. The stubs 32 so designed facilitate the selective coupling between the radiating element 11 and the central radiating element 27. The selective coupling resulting from the coupling stubs 32 is different from the coupling that may be prevailing merely due to the proximity of the third element 27 to the other two radiating elements 11 and 12 as well as due to the attachment of the third element 27 to the radiating elements 11 and 12 at 28.

In the absence of any coupling, the resonant frequency and the bandwidth of the radiating element 11 (designed for the lower resonant band of multi-band operation) are determined by: the number of loops 14, the width of the loop 14, the height of the closed end 14b as well as the dielectric constant of the flex board 13. Likewise, in a coupling-free scenario, the resonant frequency and the bandwidth of the radiating element 12 (designed for the upper resonant band of multi-band operation) are determined by: the number of loops 15, the width of the loop 15, the height of the closed end 15*b* as well as the dielectric constant of the flex board 13. Because of the introduction of the third element 27 and the presence of the coupling stubs 32 protruding into the open loop 14 of the radiating element 11, as well as the attachment of the three radiating elements 11, 12 and 27 at 28, the lower and upper resonant frequencies of the multi-band meander antenna 20 do not have complete independence on any of the three radiating elements 11, 12 and 27. The resulting resonant frequencies and the realizable bandwidth the multi-band meander antenna 20 are dependent not only on the individual resonant frequencies of the three radiating elements 11, 12 and 27, but also on parameters such as the size of the coupling stubs 32, the protrusion of the coupling stubs 32 into the open ends 14*a* of loops 14 of the radiating element 11, the separation between the radiating elements 12 and 27, the separation distance between the radiating elements 11 and 27 and the relative location of the point 28 with respect to the common feed point 16. The feasibility of design of a multi-band meander antenna 20, as suggested in the second embodiment of this invention, has been proved by the design of AMPS/GPS/PCS band meander radiator for the retracted position of a whip antenna. Like in the first embodiment of this invention, the novel feature of the design of the meander antenna 20 of the second embodiment of this invention is the realization of extended frequency range of the upper resonance to include two individual bands (GPS/PCS). The requisite bandwidth of the meander antenna 20 for the tri-band operation has also been realized without the use of an external impedance matching network. The meander antenna 20 designed and developed as proposed in the second embodiment of this invention exhibits the satisfactory gain and bandwidth to cover the resonant lower band (AMPS) and the upper resonant band (comprising GPS and PCS).

Figure 3:
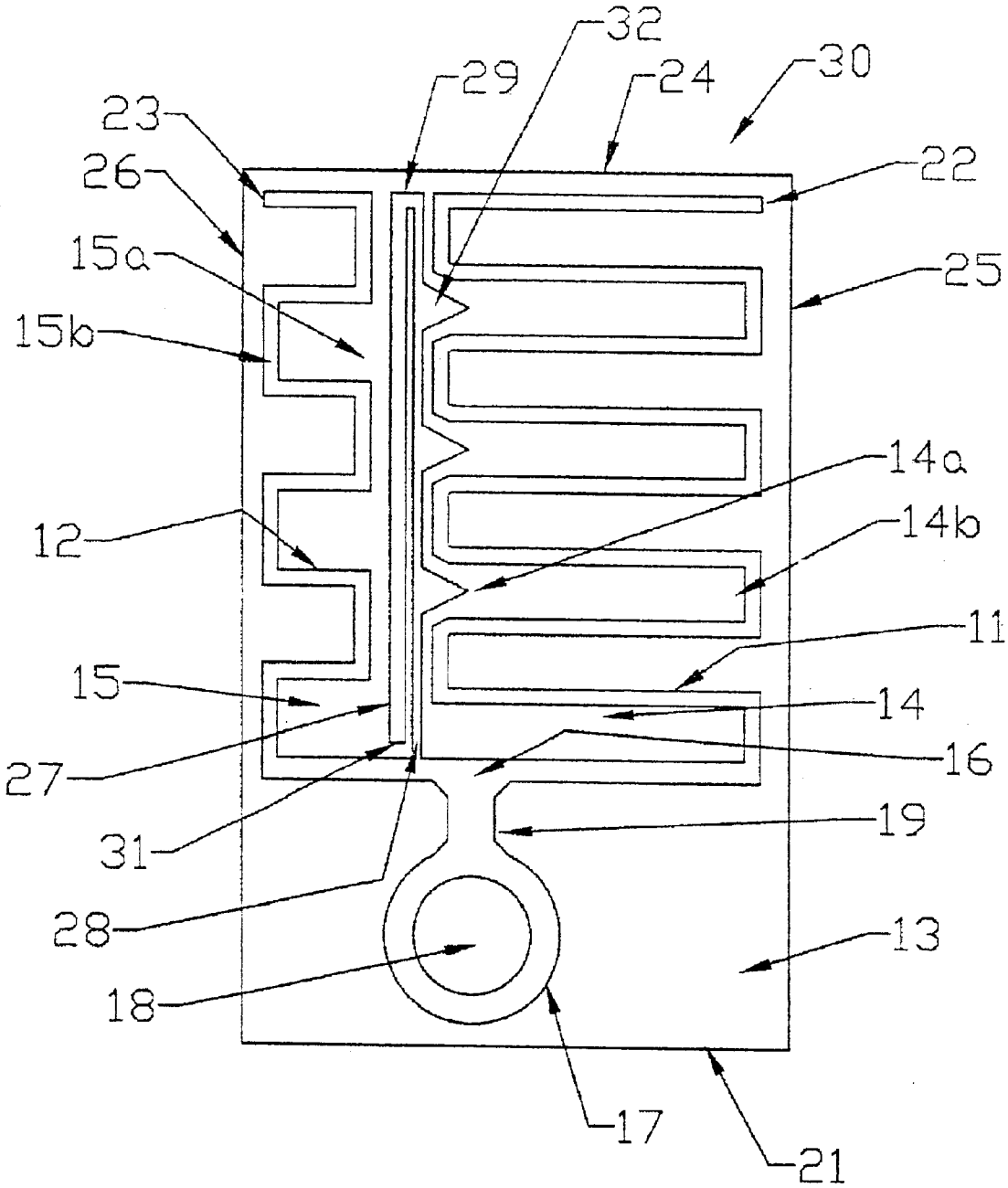
FIG. 3 is a plan view of the design configuration of a single feed multi-band meander antenna 30 with three active elements according to the third embodiment of this invention.

Like the previous embodiment, the third embodiment of this invention also relates to the design of single feed multi-band meander antenna 30 with three radiating elements for the retracted position of the whip antenna. The meander antenna 30 of the third embodiment of this invention (FIG. 3) has three radiating elements 11, 12 and 27. The only difference between the second embodiment (FIG. 2) and the third embodiment is the relative change in the disposition of the open and closed sections of the element 27 with respect to the radiating elements 11 and 12. In the third embodiment of this invention, the free end 31 of the third radiating element 27 is in close proximity to the radiating element 12 rather than to the radiating element 11. The conjuncture point 28 connecting the central radiating element 27 to the radiating elements 11 and 12 is relatively closer to radiating element 11 than the radiating element 12. Further, the coupling stubs 32 are on the closed section of the radiating element 27. The free end 31 of the radiating element 27 is placed closer to the open loop 15 of the radiating element 12. All the other numerals referred to in FIG. 3 are identical to those in FIG. 2, which have already been described in the description of the second embodiment of this invention. Further detailed description of FIG. 3 of this invention is therefore omitted for purposes of conciseness. A comparative study between the results of the second and third embodiments of this invention signifies the effect of the proximity of the point 28 relative to the open loops 14 and 15 of the radiating elements 11 and 12 on the performance of the multi-band antenna.

Similar to the second embodiment, the resulting resonant frequencies and the realizable bandwidth the multi-band meander antenna 30 of the third embodiment of this invention are dependent not only on the individual resonant frequencies of the three radiating elements 11, 12 and 27, but also on parameters such as the size of the coupling stubs 32, the protrusion of the coupling stubs 32 into the open ends 14*a* of loops 14 of the radiating element 11, the separation between the radiating elements 12 and 27, the separation distance between the radiating elements 11 and 27 and the relative location of the conjuncture point 28 with respect to the common feed point 16. The concept of multi-band meander antenna 30 suggested in the third embodiment of this invention has been implemented for the design of an AMPS/GPS/PCS band meander radiator for the retracted position of the whip antenna. The meander antenna 30 designed and developed as proposed in the third embodiment of this invention possesses the satisfactory gain and bandwidth to cover the cellular lower band (AMPS) and the upper band (comprising non-cellular GPS and upper cellular PCS). The bandwidth of the meander antenna 30 for the tri-band operation comprising the combination of non-cellular GPS and cellular PCS band for its upper resonance has also been accomplished without the requirement of an external impedance matching network.

The fourth embodiment of this invention (FIG. 4) pertains to the design illustration of single feed multi-band meander antenna 40 with three radiators for the retracted position of the whip antenna. In this embodiment, the third element 27 is not attached to the other two radiating elements 11 and 12. Therefore the third (central) element 27 of the meander antenna 40 serves as a parasitic radiator of an inverted U-shape (FIG. 4) to the adjacent elements 11 and 12. Unlike the meander radiating elements of the second (FIG. 2) and third (FIG. 3) embodiments of this invention, the third element 27 of the meander antenna 40 of the fourth embodiment has two free ends 28 and 31. Consequently, the central (third) element has two open sections. The segment of the element 27 between 29 and the free end 28 forms one of the open sections of the central element 27. Similarly, the other open section of the central element 27 comprises the segment between 29 and the free end 31. The parasitic third element 27 that is physically isolated and placed in between the radiating elements 11 and 12 is designed to act as a passive radiator rather than an active one as described in the second and third embodiments of this invention. All the other numerals referred to in FIG. 4 of the fourth embodiment of this invention are identical to those in FIG. 3 of the third embodiment of this invention. Additional description of FIG. 4 of this invention would therefore be redundant and hence is not included. The comparative studies of the results of the second (FIG. 2) and third (FIG. 3) embodiments with that of the fourth embodiment of this invention reveal the effect of the choice of the active or passive third element 27 on the resonant and gain characteristics of the multi-band meander antenna 40.

Similar to the meander antennas of the second and third embodiments of this invention, the resonant frequencies and the realizable bandwidth of the multi-band meander antenna 40 of the fourth embodiment of this invention are determined by: the resonant frequencies of the two active radiating elements 11 and 12, the resonant characteristics of the passive (parasitic) third element 27, the size of the coupling stubs 32, the protrusion of the coupling stubs 32 into the open ends 14*a* of loops 14 of the radiating element 11, the separation between the first and the third elements 11 and 27, the separation distance between the second and third elements 12 and 27. The perpendicular distance of separation between the free end 28 of the central parasitic element 27 and the line containing the common feed point 16 is also a parameter controlling the resonant and the bandwidth of the multi-band meander antenna 40. Similarly, the perpendicular distance of separation between the free end 31 of the parasitic element 27 and the line containing the common feed point 16 is one more additional design parameter to optimize the bandwidth of the multi-band meander antenna 40. The concept of a multi-band meander antenna 40 with a combination of active and passive elements proposed in the fourth embodiment of this invention has been invoked in the design of AMPS/GPS/PCS band radiator for the retracted position of the whip antenna. The meander antenna 40 designed and developed as described in the fourth embodiment of this invention is also associated with the satisfactory gain and bandwidth to cover the operating cellular lower band (AMPS) and the upper band (comprising non-cellular GPS and upper cellular PCS). The design of the single feed multi-band meander antenna 40 covering the combination of non-cellular GPS and cellular PCS bands for its upper resonant frequency of operation is also devoid of an external impedance matching network.

Figure 4:
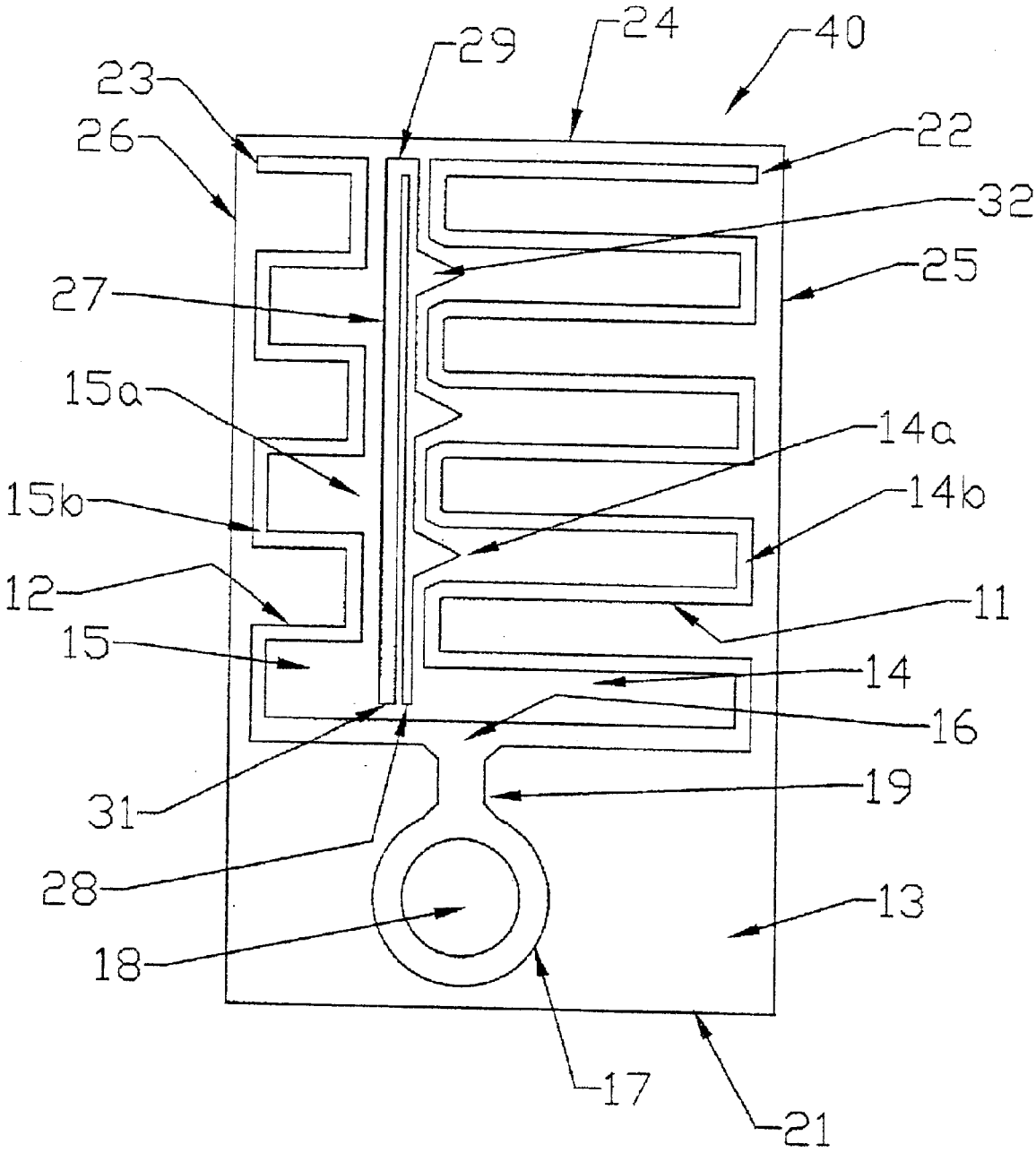
FIG. 4 is a plan view of the design configuration of single feed multi-band meander antenna 40 with three (two active and one passive) elements according to the fourth embodiment of this invention.
Figure 5:
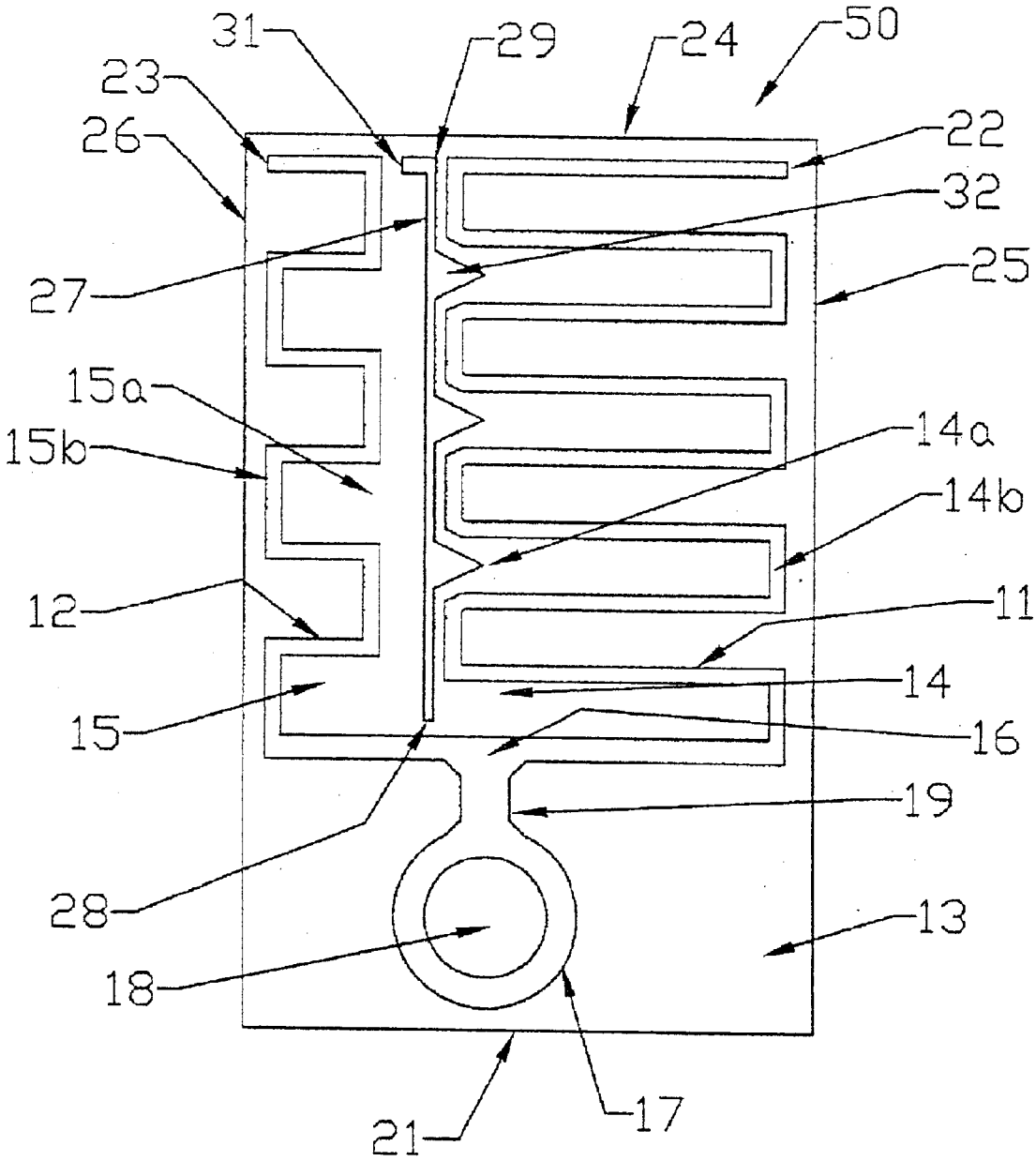
FIG. 5 is a plan view of the design configuration of a single feed multi-band meander antenna 50 with three (two active and one passive) elements according to the fifth embodiment of this invention.

The single feed multi-band meander antenna 50 of the fifth embodiment of this invention shown in FIG. 5 differs from the meander antenna 40 in the shape of the third (central) element 27 acting as a parasitic to the other radiating elements 11 and 12. In this embodiment also, the third radiator 27 is designed to be a passive element to act as a parasitic element as explained hereinabove with respect to the fourth embodiment of this invention. The third element 27 of the fifth embodiment (FIG. 5) of this invention has the shape of an inverted-L instead of an inverted U-shape as in FIG. 4. As a result of this choice for the shape of the third (central) element 27 in FIG. 5, the parasitic third element 27 has a significantly reduced length and has only one open section comprising the segment between 28 and 29. In the fifth embodiment also, the open section of the parasitic element 27 has the coupling stubs 32 protruding into the open ends 14*a* of loops 14 of the radiating element 11. In this embodiment also, the vertical segment between 28 and 29 forming the open section of the third element 27 is in close proximity to loops 14 of the radiating element 11. The free end 28 of the parasitic third element 27 is closer to the line containing the common feed point 16. The other free end 31 of the third element 27 is near the free ends 22 and 23 of the radiating elements 11 and 12 located in the vicinity of top edge 24 of the flex board 13. All the other numerals referred to in FIG. 5 of the fifth embodiment of this invention are identical to those in FIG. 4, which have already been explained while describing the fourth embodiment of this invention. Therefore, further description of the FIG. 5 embodiment will not be included herein for purposes of conciseness.

The resonant frequencies and bandwidth around the resonant frequencies of the multi-band meander antenna 50 of the fifth embodiment of this invention are controlled by: the resonant frequencies of the two active radiating elements 11 and 12, the resonant characteristics of the passive (parasitic) third element 27, the size of the coupling stubs 32, the protrusion of the coupling stubs 32 into the open ends 14*a* of loops 14 of the radiating element 11, the separation between the first and the third elements 11 and 27, the separation distance between the second and third elements 12 and 27. An additional parameter that affects the resonant as well as the bandwidth characteristics of the multi-band meander antenna 40 is the perpendicular distance of separation between the free end 28 of the central parasitic element 27 and the line containing the common feed point 16.

The concept of a multi-band meander antenna 50 with a combination of two active elements 11 and 12 and a passive third element 27 of L-shape as proposed in the fifth embodiment of this invention has been employed in the design of (AMPS/GPS/PCS) band meander radiator of a retractable antenna. The meander antenna 50 designed and developed as described in the fifth embodiment of this invention exhibits the satisfactory gain and bandwidth to cover the resonant lower band (AMPS) and the upper resonant band (comprising non-cellular GPS and upper cellular PCS). Like the previous embodiments of this invention, the design objective of the multi-band meander antenna 50 covering the combination of non-cellular GPS and cellular PCS bands for its upper resonant frequency of operation has been accomplished without the requirement of the external impedance matching network. The influence of the shape of the passive third element 27 on the bandwidth and the radiation characteristics of the multi-band meander antenna 50 is brought out through a comparative study of the results of the fourth (FIG. 4) and the fifth (FIG. 5) embodiments of this invention.

Figure 6:
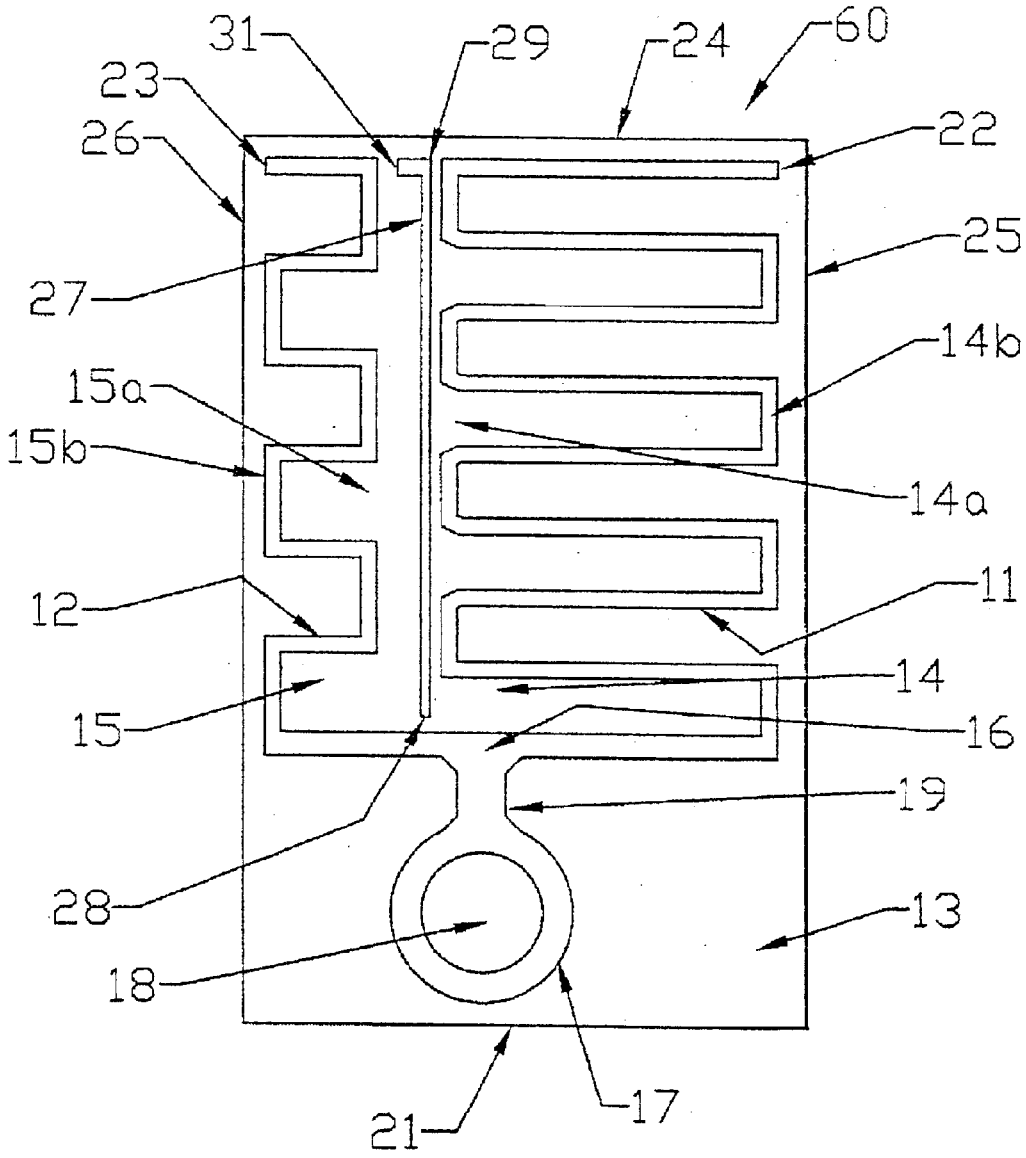
FIG. 6 is a plan view of the design configuration of a single feed multi-band meander antenna 60 with three (two active and one passive) elements according to the sixth embodiment of this invention.

The single feed multi-band meander antenna 60 of the sixth embodiment of this invention shown in FIG. 6 differs from the meander antenna 50 of the fifth embodiment in the configuration of the third (central) element 27 acting as a parasitic to the other radiating elements 11 and 12. Even in the sixth embodiment of this invention, the third element 27 is configured as a passive radiator and hence it serves as a parasitic to the other radiating elements 11 and 12 as explained above relating to the fifth embodiment of this invention. The parasitic element 27 has a significantly reduced length and has only one open section comprising the segment between 28 and 29. The third element 27 of the sixth embodiment does not have the coupling stubs 32 protruding into the open ends 14*a* of loops 14 of the radiating element 11. The absence of the coupling stubs on the third element 27 is the only difference between the sixth (FIG. 6) and the fifth embodiments (FIG. 5) of this invention. Like in FIG. 5, the parasitic element 27 of the sixth embodiment also has a significantly reduced length and has only one open section comprising the segment between 28 and 29. The open section of the parasitic element 27 of the sixth embodiment is without the coupling stubs 32 protruding into the open ends 14*a* of loops 14 of the radiating element 11. The vertical segment between 28 and 29 forming the open section of the third element 27 of FIG. 6 is in close proximity to loops 14 of the radiating element 11. The free end 28 of the parasitic third element 27 is closer to the line containing the common feed point 16. The other free end 31 of the third element 27 is near the free ends 22 and 23 of the radiating elements 11 and 12 located closer to the top edge 24 of the flex board. All the other numerals referred to in FIG. 6 of the sixth embodiment of this invention are identical to those in FIG. 5, which have already been explained with respect to the fifth embodiment of this invention. Therefore further description of the FIG. 6 is not deemed necessary.

The resonant frequencies and bandwidth around the resonant frequencies of the multi-band meander antenna 60 of the sixth embodiment of this invention depend on: the resonant frequencies of the two active radiating elements 11 and 12, the resonant characteristics of the passive (parasitic) third element 27, the separation between the first and the third elements 11 and 27, and the separation distance between the second and third elements 12 and 27. An additional parameter that affects the resonant as well as the bandwidth characteristics of the multi-band meander antenna 60 is the perpendicular distance of separation between the free end 28 of the central parasitic element 27 and the line containing the common feed point 16.

Applying the design concept of a multi-band meander antenna 60 with a combination of two active elements and a passive third element of L-shape as proposed in the sixth embodiment of this invention, a meander antenna of a retractable antenna operating in the AMPS/GPS/PCS bands has been developed. The multi-band meander antenna 60 developed based on the design proposed in the sixth embodiment of this invention shows satisfactory bandwidth and gain performance characteristics. Like the previous embodiments of the multi-band meander antennas of this invention, the meander antenna 60 developed on the design principles of the sixth embodiment of this invention also accomplishes the requisite bandwidth for the tri-band performance covering the dual cellular bands (AMPS/PCS) and the non-cellular GPS band without the use of the external matching network. The relative comparison of the results of the fifth (FIG. 5) and the sixth (FIG. 6) embodiments of this invention offers an insight into the influence of the coupling stubs 32 on the bandwidth as well as the radiation characteristics of the multi-band meander antenna 50.

Figure 7:
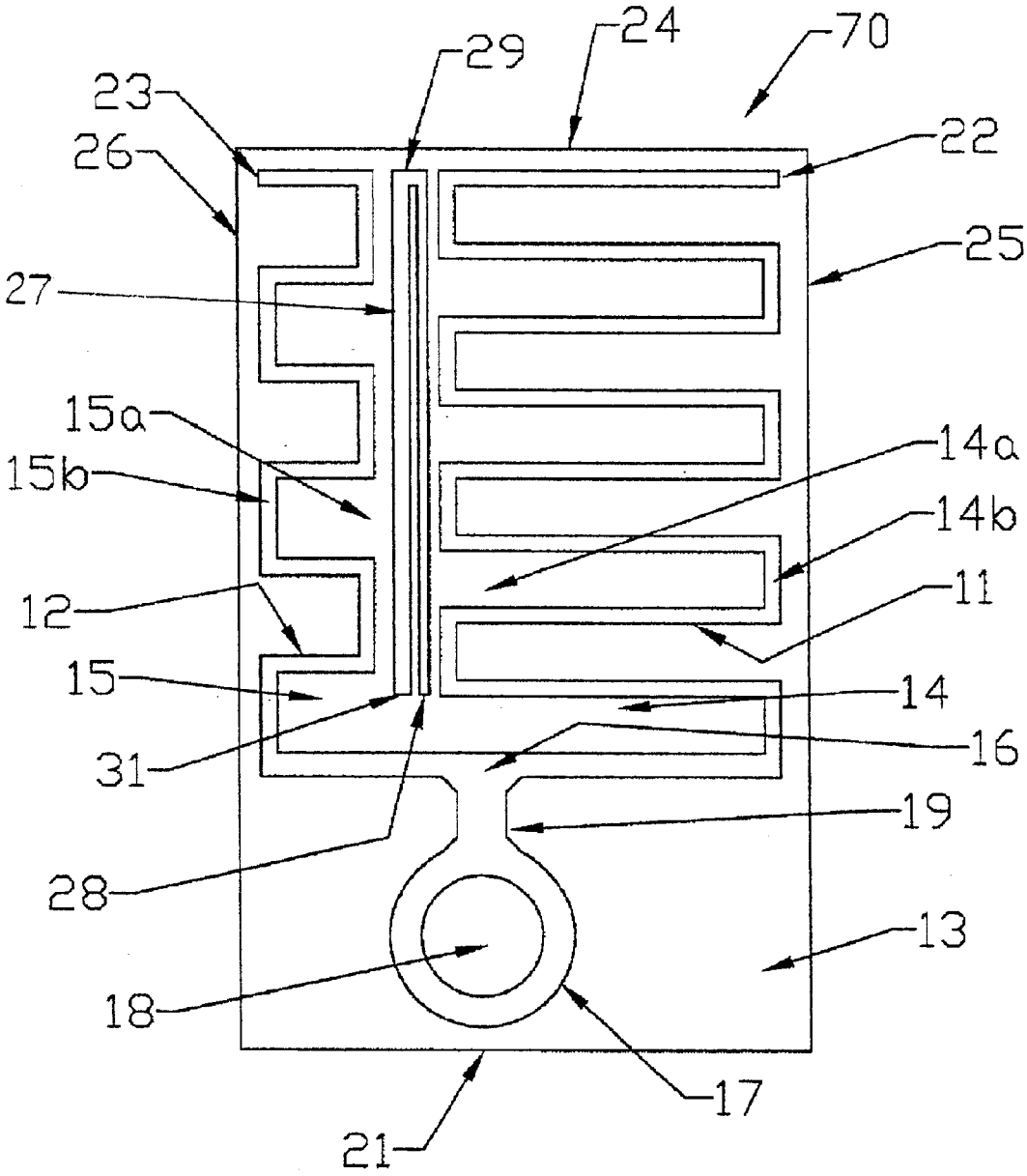
FIG. 7 is a plan view of the design configuration of a single feed multi-band meander antenna 70 with three (two active and one passive) elements according to the seventh embodiment of this invention.

In the seventh embodiment of this invention, the third radiator 27 of the meander antenna 70 is a passive element designed to act as a parasitic to the other radiating elements 11 and 12 (FIG. 7). Like the meander antenna 60 of the sixth embodiment of this invention, the parasitic third element 27 of the seventh embodiment of this invention (FIG. 7) also does not have the coupling stubs 32 protruding into the open ends 14*a* of loops 14 of the radiating element 11. The only difference between the sixth (FIG. 6) and the seventh (FIG. 7) embodiments of this invention lies in the shapes of the parasitic third (central) element 27. The third element 27 of the meander antenna 70 of FIG. 7 is of an inverted U-shape instead of an inverted L-shape, as in FIG. 6. Therefore the central (third) element 27 has two open sections. The segment of the third element 27 between 29 and the free end 28 forms one of the open sections of the central element 27. Similarly, the other open section of the central element 27 comprises the segment between 29 and the free end 31. The parasitic third element 27 that is physically isolated and placed in between the radiating elements 11 and 12 is designed to act as a passive radiator rather than an active one. All the other numerals referred to in the seventh embodiment (FIG. 7) of this invention are identical to those in the sixth embodiment (FIG. 6) of this invention. Additional description of FIG. 7 of this invention would therefore be redundant and hence is omitted.

The resonant frequencies and the realizable bandwidth the multi-band meander antenna 70 of the seventh embodiment of this invention are governed by: the resonant frequencies of the two active radiating elements 11 and 12, the resonant characteristics of the passive (parasitic) third element 27, the separation between the first and the third elements (11,27), the separation distance between the second and third elements 12 and 27. The perpendicular distance of separation between the free end 28 of the central parasitic element 27 and the line containing the common feed point 16 is also a parameter controlling the resonant and the bandwidth characteristics of the multi-band meander antenna 70. Similarly, the perpendicular distance of separation between the free end 31 of the parasitic element 27 and the line containing the common feed point 16 is one more additional design parameter to optimize the bandwidth of the multi-band meander antenna 70. The concept of a multi-band meander antenna 70 with a combination of active and passive elements proposed in the seventh embodiment of this invention has been applied in the design of (AMPS/GPS/PCS) band meander radiator of a retractable antenna. The meander antenna 70 designed and developed as described in the seventh embodiment of this invention is also associated with the satisfactory gain and bandwidth to cover the cellular lower band (AMPS) and the upper band (comprising non-cellular GPS and upper cellular PCS). Like the meander antennas of the other embodiments of this invention, the design of the meander antenna 70 for AMPS/PCS/GPS bands is also devoid of an external impedance matching network. The relative comparison of the results of the sixth (FIG. 6) and the seventh (FIG. 7) embodiments of this invention reveals the influence of the shape of the third element 27 (without coupling stubs) on the bandwidth/radiation characteristics of the multi-band meander antennas 60 and 70. Similarly, a relative comparison of the results of the fourth (FIG. 4) and the seventh (FIG. 7) embodiments of this invention facilitates the study of influence of coupling stubs 32 of the parasitic third element 27 on the bandwidth/gain characteristics of the multi-band meander antenna 40.

Figure 8:
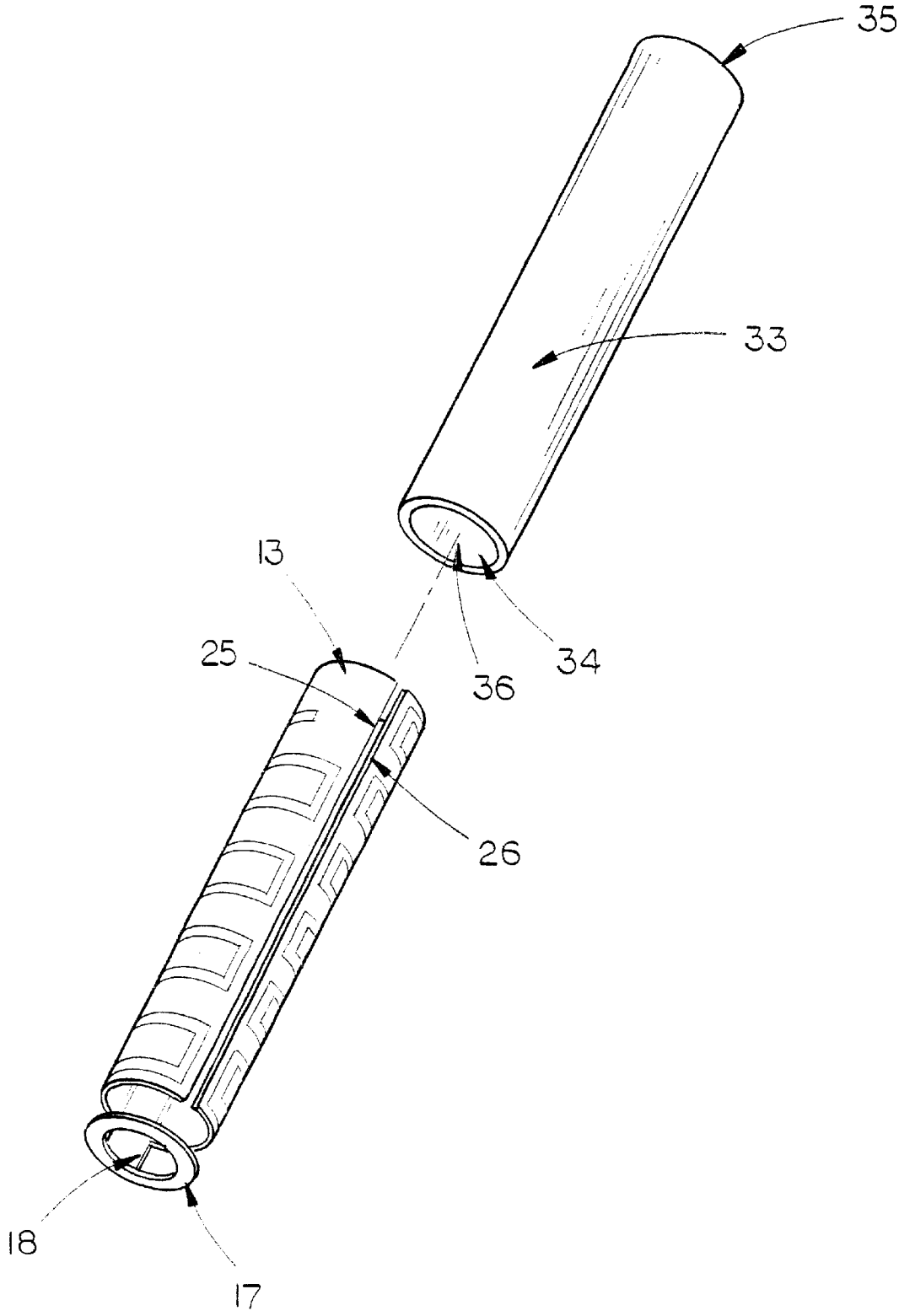
FIG. 8 is an exploded perspective view illustrating the manner of wrapping the meander antenna around a dielectric spacer.
Figure 10:
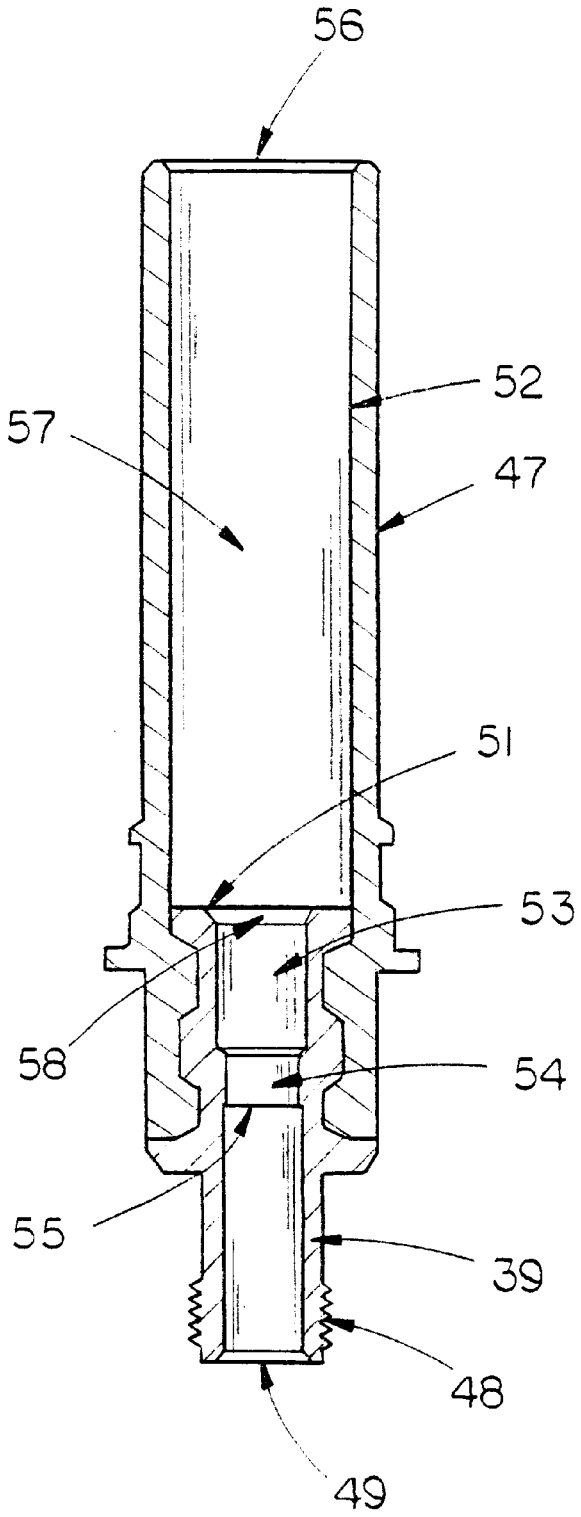
FIG. 10 is a sectional view of the inner plastic housing with a RF connector.

The multi-band meander antennas illustrated in FIGS. 1–7 of this invention are placed inside a inner plastic housing 47 of cylindrical shape (to be explained while describing FIG. 10). To facilitate the placement of the meander antennas 10–70 of this invention into the above-referenced plastic housing 47, the meander antennas formed on a flex board 13 are wrapped around a cylindrical dielectric spacer 33 of predetermined dielectric constant as shown in FIG. 8. The dielectric spacer offers the effective dielectric loading to lower the resonant frequency of the meander antenna without increasing its physical size. As can be seen in FIG. 8, the flex board 13 wrapped on the surface of the dielectric spacer 33 has its side edges 25 and 26 held parallel to each other. The edges 25 and 26 of the flex board 13 containing the meander antenna are either made to touch each other or at least held in very close proximity of each other (FIG. 8). The surface 34 at the bottom end of the dielectric spacer 33 is allowed to rest on the feed tab 17 of the meander antenna, as shown in FIG. 8. The length of the dielectric spacer 33 is chosen so that the surface 35 at the top end of the dielectric spacer 33 does not protrude beyond the top edge 24 of the flex board 13. The central hole 36 extends the full length of the dielectric spacer 33. The diameter of the dielectric spacer 33 is slightly smaller than the inner diameter of the plastic housing 47. The meander antenna wrapped around the dielectric spacer 33 is then placed inside the plastic housing 47 of FIGS. 10 and 11. Such a placement results in the meander antenna being confined to the annular region formed between the dielectric spacer 33 and the inner wall of the plastic housing 47 both of which are of cylindrical in shape. The diameter of the dielectric spacer 33 is chosen to allow easy and smooth placement of the meander antenna within the plastic housing 47. The length "L" of the flex board 13 in FIGS. 1–7 of this invention is chosen to prevent the flex board from protruding out of the plastic housing 47. Similarly, the width "W" of the flex board 13 in FIGS. 1–7 is either almost equal to or minutely smaller than the circumference of the dielectric spacer 33. Such a restriction on the width of the flex board 13 allows only a single encirclement of flex board 13 on the dielectric spacer 33 and therefore avoids the overlap of the radiating elements of the meander antenna formed on the flex board 13. The suggested wrapping of the meander antenna around the dielectric spacer 33 shown in FIG. 8 allows its placement within a cylindrically shaped plastic housing 47 of pre-designed size (to be explained while describing FIGS. 10 and 11).

Figure 9A:
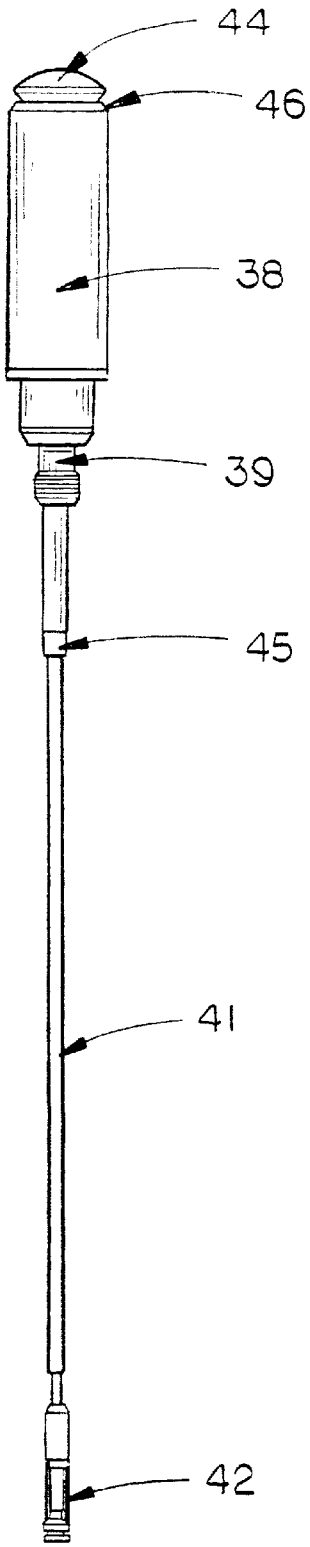
FIG. 9A is a plan view of the retracted position of the multi-band whip antenna with the meander antenna inside a plastic housing with a RF connector.
Figure 9B:
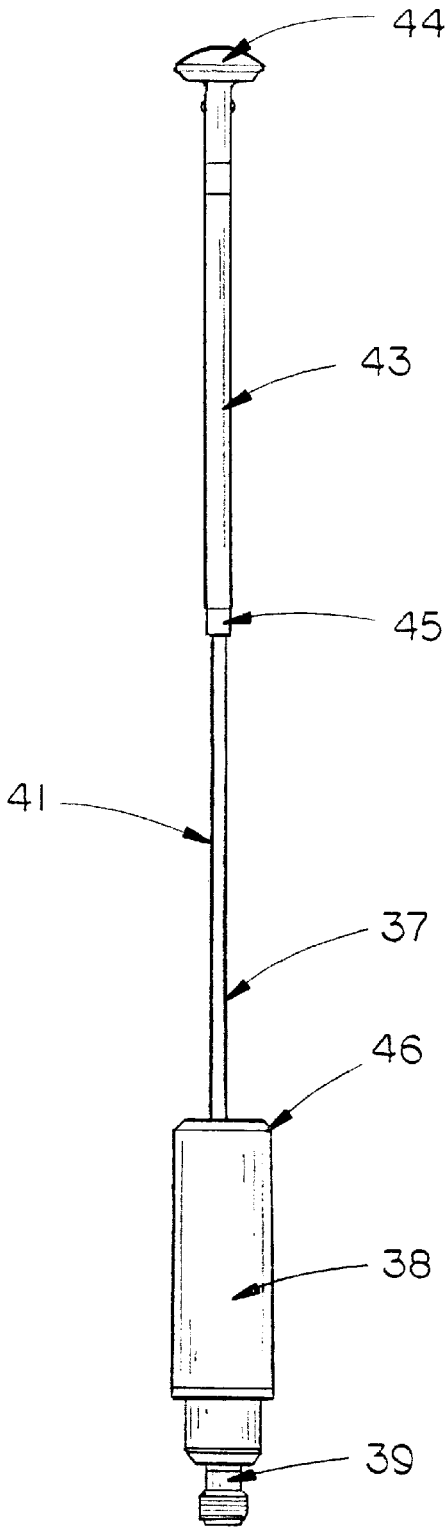
FIG. 9B is a plan view of the extended position of the multi-band retractable antenna with the meander antenna inside a plastic housing with a RF connector.

The functional configurations of the retractable whip antenna 37 in its extended and the retracted positions are shown in FIGS. 9A and 9B. While FIG. 9A illustrates the retracted configuration of the whip antenna 37, the whip antenna 37 in its extended configuration is illustrated in FIG. 9B. With the whip antenna 37 in its the extended position, the meander antennas (10–70 in FIGS. 1–7, respectively) of this invention enclosed within the plastic cover 38 are supposed to play a passive role in the radiation performance of the whip antenna 37. The plastic cover 38 is usually located near one of the corners at the top edge of a cellular handset. The segment 41 of the whip antenna 37 consists of linear conductive wire having a stopper 42 at its bottom end (FIG. 9A). When the whip antenna 37 is in the extended position, the stopper 42 establishes electrical contact with the RF metal connector 39 and hence the stopper 42 facilitates the connection of the whip antenna 37 to the RF feed path of the radio device. At the top end of the whip antenna 37 is an elongated dielectric rod 43 terminated by a holder 44. The length of the whip antenna 37 as measured from the tip of its stopper 42 (enclosed within the connector 39 in FIG. 9B) and slightly protruding inside the elongated dielectric rod 43 attached at 45 is designed approximately for a quarter wave length at the lower resonant band of operation. The length of the dielectric rod 43 is designed to enable the junction 45 to be located slightly below the bottom end of the connector 39 in the retracted position of the whip antenna 37 and the plastic knob 44 is made to rest on the surface 46 at the top end of the plastic cover 38 (FIGS. 9A and 9B). The above-mentioned restriction on the length of the rod 43 minimizes the effect of whip antenna 37 (in its retracted position) on the meander antenna enclosed within the plastic cover 38. In addition, the above restriction also ensures that the whip antenna 37(in its retracted position) does not protrude outside the surface 46 on the top end of the plastic cover 38. From FIG. 9A, it is seen that in the retracted position of the whip antenna 37, only the meander antenna enclosed within the plastic cover 38 is connected to the RF connector 39 since the whip antenna 37 has no physical contact with the RF connector 39 and is therefore decoupled from the meander antenna. Therefore, in the retracted position of the whip antenna 37 as shown in FIG. 9A, the meander antenna placed inside the plastic cover 38 is the dominant radiator. In the extended position of the whip antenna 37 (FIG. 9B), the meander antenna placed within the plastic cover 38 will also be connected to the RF connector 39 and therefore the meander antenna is not decoupled in the extended position of the whip antenna 37. In its extended position, the whip antenna 37 is the dominant radiator since it extends well above the meander antenna placed inside the plastic cover 38.

The eighth embodiment of this invention refers to the plastic cover 38 which encloses the meander antennas of the previous embodiments of this invention. The plastic cover 38 encloses the inner housing 47 (shown in FIG. 10) and includes an outer surface 59 (shown in FIG. 11). FIG. 10 illustrates the inner housing 47 which is positioned without the plastic cover 38. The RF connector 39 is positioned in the lower end of the inner housing 47, as seen in FIG. 10. The inner plastic housing 47 and the RF connector 39 are formed as a single over-molded part (FIG. 10). The RF connector 39 offers a common RF feed path to both the meander antenna and the whip antenna of the multi-band antenna of this invention. Through the threading 48 at the bottom end 49 of the connector 39, the multi-band antenna of this invention (in extended or retracted position) can be connected to the RF port of the radio device. Although threads are shown, the connector 39 could be mounted in the housing of the radio device by means of snap-in technology. The outer diameter at the top end 51 of the metal connector 39 is such that when placed inside the plastic housing 47, it firmly engages the inner wall 52 of the plastic housing 47. The inner diameters at the top end 51 and the bottom end 49 of the connector 39 are identical. The inner diameter of the connector 39 is chosen to allow the smooth movement of the whip antenna (including the stopper 42 attached to the lower end of the whip shown in FIG. 9) through its hollow central section 53. In the extended position of the whip antenna, the stopper 42 (FIG. 9) of the whip antenna cannot be pulled above the lower section 55 of the region 54 of the RF connector 39. For this purpose, the inner diameter of the connector 39 in the region 54 is chosen to be slightly smaller than the diameter of the stopper 42 (of FIG. 9) of the whip antenna. Such an arrangement prevents the upward movement of the stopper 42 of the whip antenna 37 (FIG. 9) through the region (stepped down) 54 and thereby the stopper 42 is held firmly to the lower section 55 of the region 54 of the connector 39. The length between the lower section 55 of the region (stepped down) 54 and the bottom end 49 of the connector 39 is just enough to fully enclose the entire stopper 42 of the whip antenna 37 within the connector 39 (FIG. 9). Such an arrangement ensures that the stopper 42 does not protrude outside the bottom end 49 of the connector 39. The distance between the top edge 56 of the inner plastic housing 47 and the top end 51 of the connector 39 is such that the meander antenna (FIGS. 17 and FIG. 8) of this invention of desired length can be placed fully within the hollow cylindrical cross section 57 of the plastic housing 47. Such a choice also ensures that the meander antenna does not protrude above the top edge 56 of the inner plastic housing 47. At the top end 51 of the metal connector 39 is a central hole 58 whose diameter is equal to the diameter of the central hole 18 of the feed tab 17 of the meander antennas of FIGS. 1–7. The meander antennas with dielectric spacer 33 (of FIGS. 1–7 and 8) are inserted into the plastic housing 47 by ensuring that its feed tab 17 is placed over the top end 51 of the connector 39 held in pre desired position inside the plastic housing 47. The contact realized through the placement of the feed tab 17 of the meander antennas directly over the top end 51 of the connector 39 establishes the connection between the meander antenna and the connector 39.

In the retracted position, with the feed tab 17 of the meander antenna alone (FIGS. 1–7) being in contact with connector 39, through the top end 51 of the connector 39, only the meander antenna will be connected to the RF input port of the device. As shown in FIG. 11, the plastic cover 38 fully encloses the inner plastic housing 47. There is a central hole 61 in the surface 46 at the top end of the plastic cover 38. The center of the hole 61 on the surface 46 (FIG. 11), the center of the hole 36 on the dielectric spacer 33 (FIG. 8), the center of the hole 58 on the top end 51 of the connector 39 and the center of the hollow region at the bottom end 49 of the connector 39 (FIG. 10) lie on a single line forming the central axis of the multi-band antenna 80 comprising the meander antennas (10–70 in FIGS. 1–7, respectively) and the retractable whip antenna 37 of this invention shown in FIG. 11. The diameters of the holes 61, 36 and 58 referenced above are slightly larger than the diameter of the whip antenna 37 to facilitate easy movement of the whip antenna while switching between its extended and retracted positions. The diameter of the hollow region at the bottom end 49 of the connector 39 is chosen to be slightly larger than the diameter of the stopper 42 (FIGS. 9 and 11) to provide easy movement of the stopper 42 into the connector 39 during the extended position of the whip antenna 37.

Figure 11A:
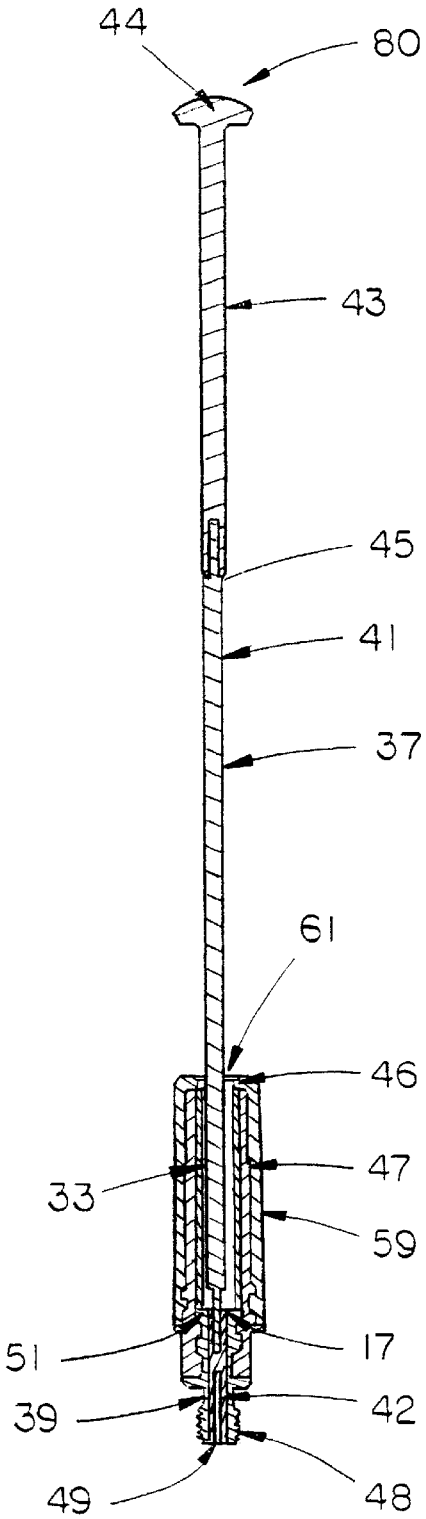
FIG. 11A is a sectional view of the extended position of the multi-band retractable antenna with the meander antenna inside a plastic housing with a RF connector.
Figure 11B:
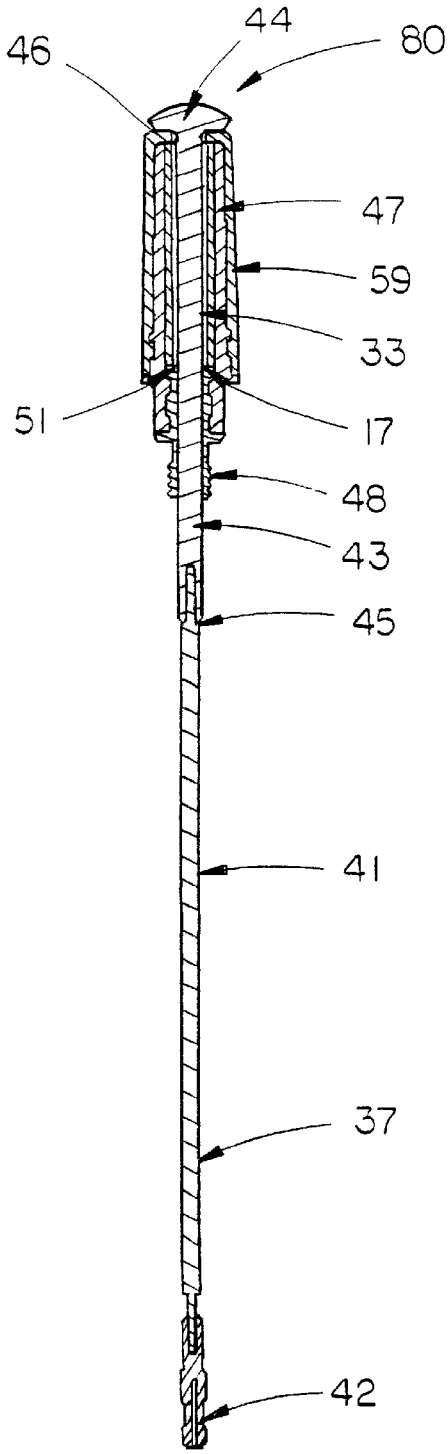
FIG. 11B is a sectional view of the retracted position of the multi-band retractable antenna with the meander antenna inside a plastic housing with a RF connector.

The composite assembly of the whip antenna 37, the meander antennas (10–70 in FIGS. 1–7, respectively) of this invention, the plastic cover 38 with metal connector 39 is shown in FIGS. 11A and 11B. While FIG. 11A illustrates the composite assembly in the extended position of the whip antenna 37, FIG. 11B illustrates the corresponding retracted position of the whip antenna 37. The sequence of assembling the meander antennas and the whip antenna of this invention is as follows. Each meander antenna (10–70 in FIGS. 1–7, respectively) formed on a flex board 13 and wrapped around a dielectric spacer 33 (as explained in FIG. 8) is placed inside the inner plastic housing 47 of the plastic cover 38 such that the feed tab 17 of the meander antenna is in direct contact with the top end 51 of the RF connector 39 (FIGS. 10 and 11). The above placement ensures the RF feed path for the meander antenna through the connector 39. The outer plastic cover 59 is then placed over the inner plastic housing 47. With this, the surface wall 46 at the top end of the plastic cover 59 fully encloses the open surface 56 (FIG. 10) at the top end of the inner plastic cover 47.

The whip antenna 37 consisting of the elongated dielectric rod 43 with a knob 44 and the segment 41 (without the stopper 42) is inserted through: the central hole 61 on the outer plastic cover 59, the central hole 36 on the dielectric spacer 33 placed inside the inner plastic housing 47, the hole 58 at the top end of the connector 39, the hollow interior cross section of the connector 39 and the bottom end 49 of the connector 39. The metal stopper 42 is then crimped to the free end of the whip antenna 37 protruding out of the bottom end 49 of the connector. With the attachment of the stopper 42, the whip antenna 37 can be pulled up till the stopper 42 makes a firm contact with the bottom section 55 of the (stepped down) region 54 of the connector 39 (FIG. 10). This establishes the direct contact between the whip antenna 37 and the connector 39 resulting in the configuration for the extended position of the whip antenna 37 and hence of the multi-band antenna 80 shown in FIG. 11A. In the extended position of the whip antenna 37, meander antennas (10–70 of FIGS. 1–7) are also simultaneously connected to the RF connector 39 because of the placement of the feed tab 17 over the top end 51 of the connector and which in turn ensures that the meander antennas placed inside the plastic housing 47 are coupled to the whip antenna 37 in its extended position. The coupling between the whip antenna 37 and the meander antenna placed inside the plastic housing 47 needs to be adjusted to get the optimum performance in the extended position of the multi-band antenna 80.

To realize the retracted position of the multi-band antenna 80, the whip antenna 37 is pushed down with the help of knob 44 till the knob 44 rests on the surface 46 of the outer plastic cover 59 (FIG. 11B). In this position, the stopper 42 of the whip antenna 37 does not establish any contact with the RF connector 39 resulting in its decoupling. Through the design restriction that the conjuncture point 45 of the whip antenna 37 is located at a pre-designed distance below the bottom end 49 of the connector 39, the capacitive coupling because of the proximity of the whip antenna 37 to the meander antenna inside the housing 47 can be minimized.

Based on the above concept and the details of all the embodiments proposed in this invention, the single feed multi-band retractable antennas comprising the whip and the meander antennas have been designed/developed to conform to the retracted and extended positions illustrated in FIGS. 11A and 11B. The tri-band frequency of operation of all the multi-band retractable antennas developed based on the concepts proposed in this invention includes the AMPS band at its lower resonance and the combined GPS/PCS bands at its upper resonance. All the multi-band retractable antennas of this invention exhibit requisite satisfactory bandwidth in both the extended and retracted positions. The realized bandwidths of all the multi-band retractable antennas of this invention are without the use of an external impedance matching network in both its extended and the retracted positions. The design of tri-band (AMPS/PCS/GPS) meander antennas of a retractable antenna devoid of an external impedance matching network either for the extended or for the retracted position is one of the primary objectives of this invention.

Figure 12A:
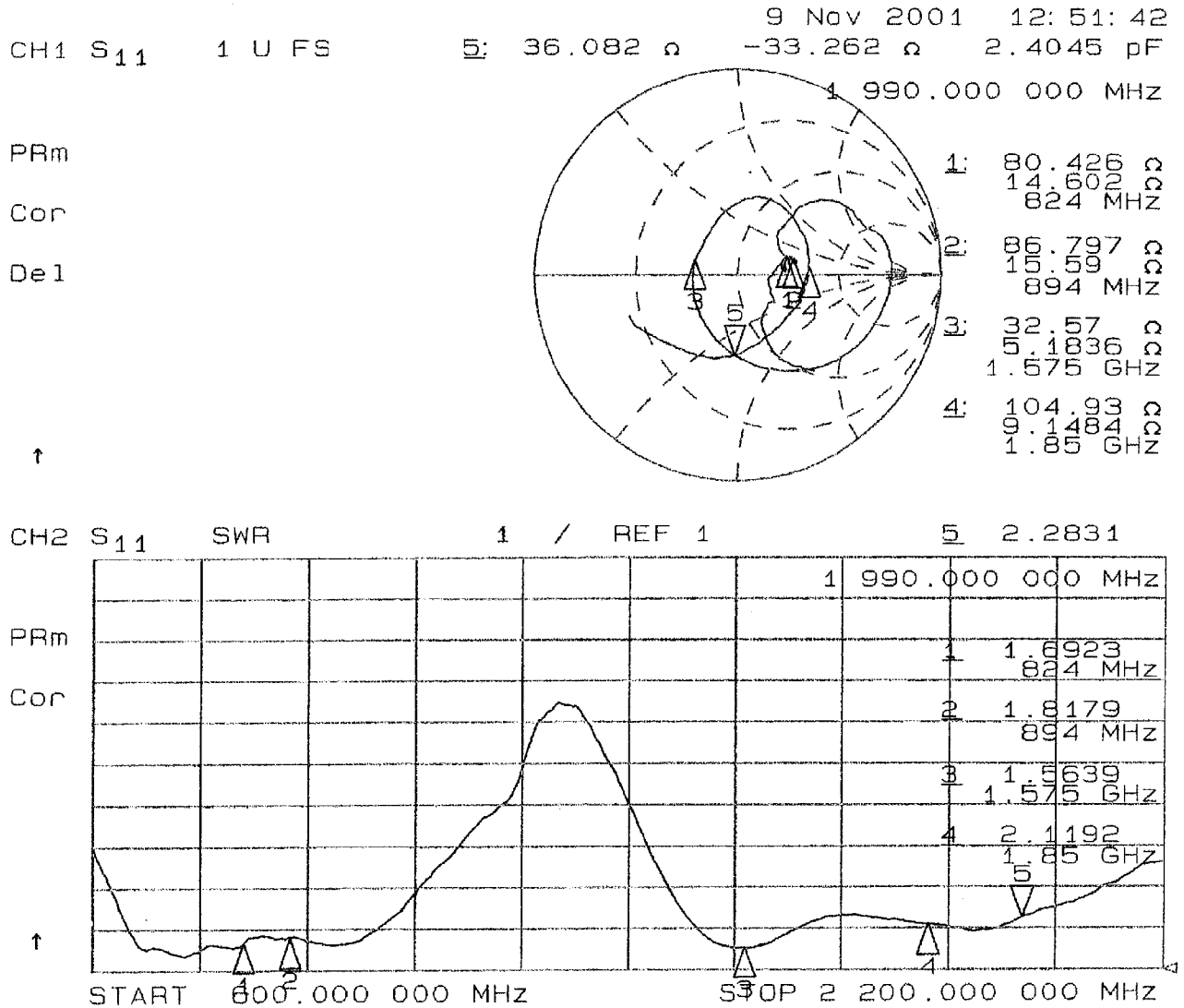
FIG. 12A is a frequency response chart which depicts the VSWR and impedance characteristics of the extended position of the multi-band retractable antenna of FIG. 11A with the meander antenna 20 of the embodiment of FIG. 2.
Figure 12B:
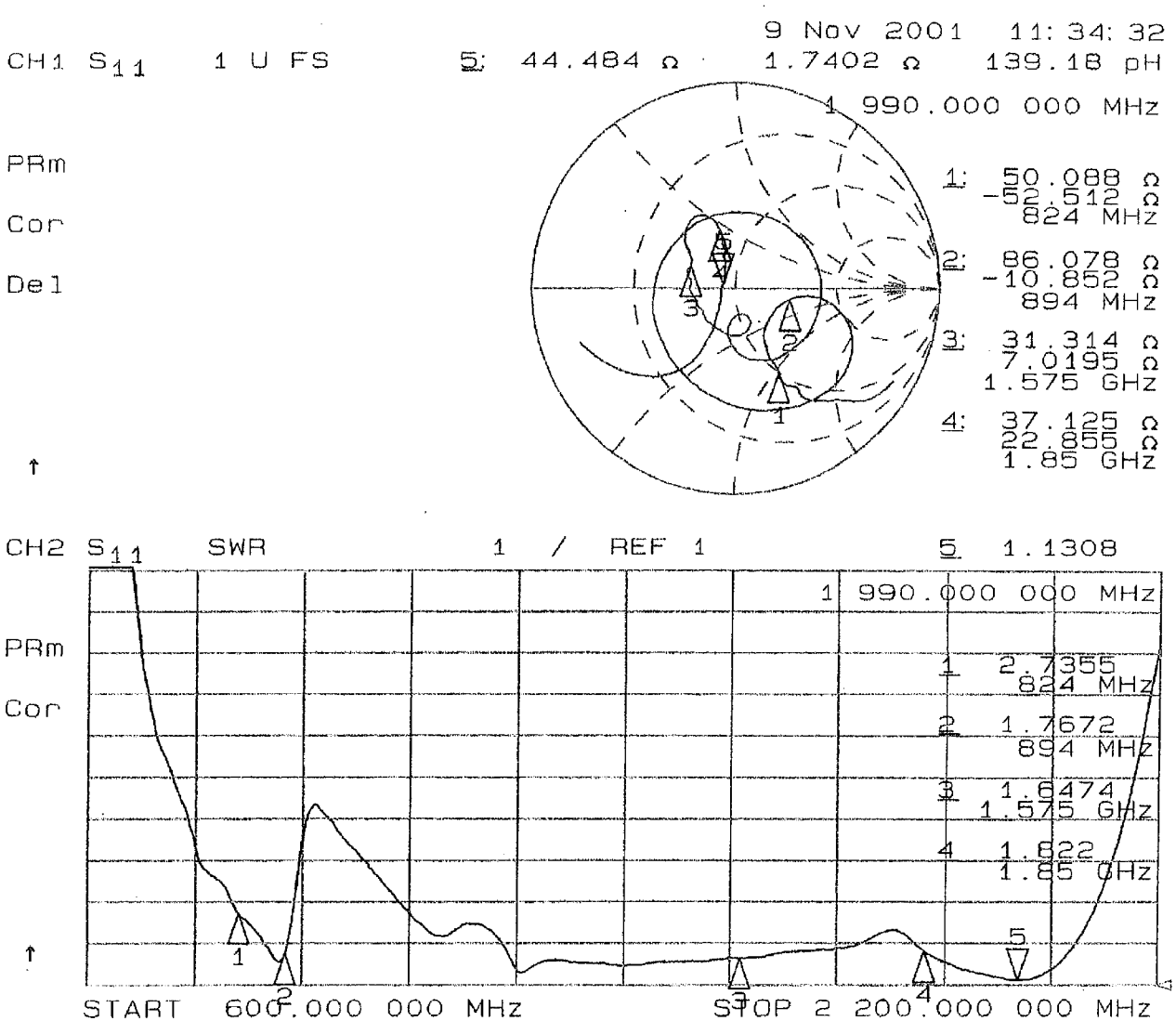
FIG. 12B is a frequency response chart which depicts the VSWR and impedance characteristics of the retracted position of the multi-band whip antenna of FIG. 11B with the meander antenna 20 of the embodiment of FIG. 2.

The results of the frequency response (VSWR and impedance) of the meander antenna 20 of the second embodiment (FIG. 2) of this invention configured along with a retractable whip antenna (FIG. 11) are shown in FIGS. 12A and 12B. FIG. 12A is the frequency response (VSWR and impedance) of the multi-band antenna (composite assembly of FIG. 11A consisting of the whip antenna 37 and the meander antenna 20 of the second embodiment [FIG. 2]) of this invention in its extended position. The corresponding frequency response (VSWR and impedance) of the above multi-band antenna in its retracted position (FIG. 11B) is shown in FIG. 12B. From the results of the VSWR plots of FIGS. 12A and 12B, it is seen that the proposed multi-band antenna has realized requisite bandwidth for the tri-band operation covering the AMPS (cellular) for its lower band and the combined PCS (cellular) and GPS (non-cellular) for its upper band. In the meander antenna 20 (FIG. 2) of the second embodiment of this invention, the third (central) element 27 is a linear radiator connected to the adjacent elements 11 and 12. The coupling stubs 32 on the element 27 protrude into the radiating element 11 primarily designed for resonant frequency of the lower band. The conjuncture point 28 that connects the third element 27 to the adjacent elements 11 and 12 is relatively closer to the loop 15 of the radiating element 12.

Figure 13A:
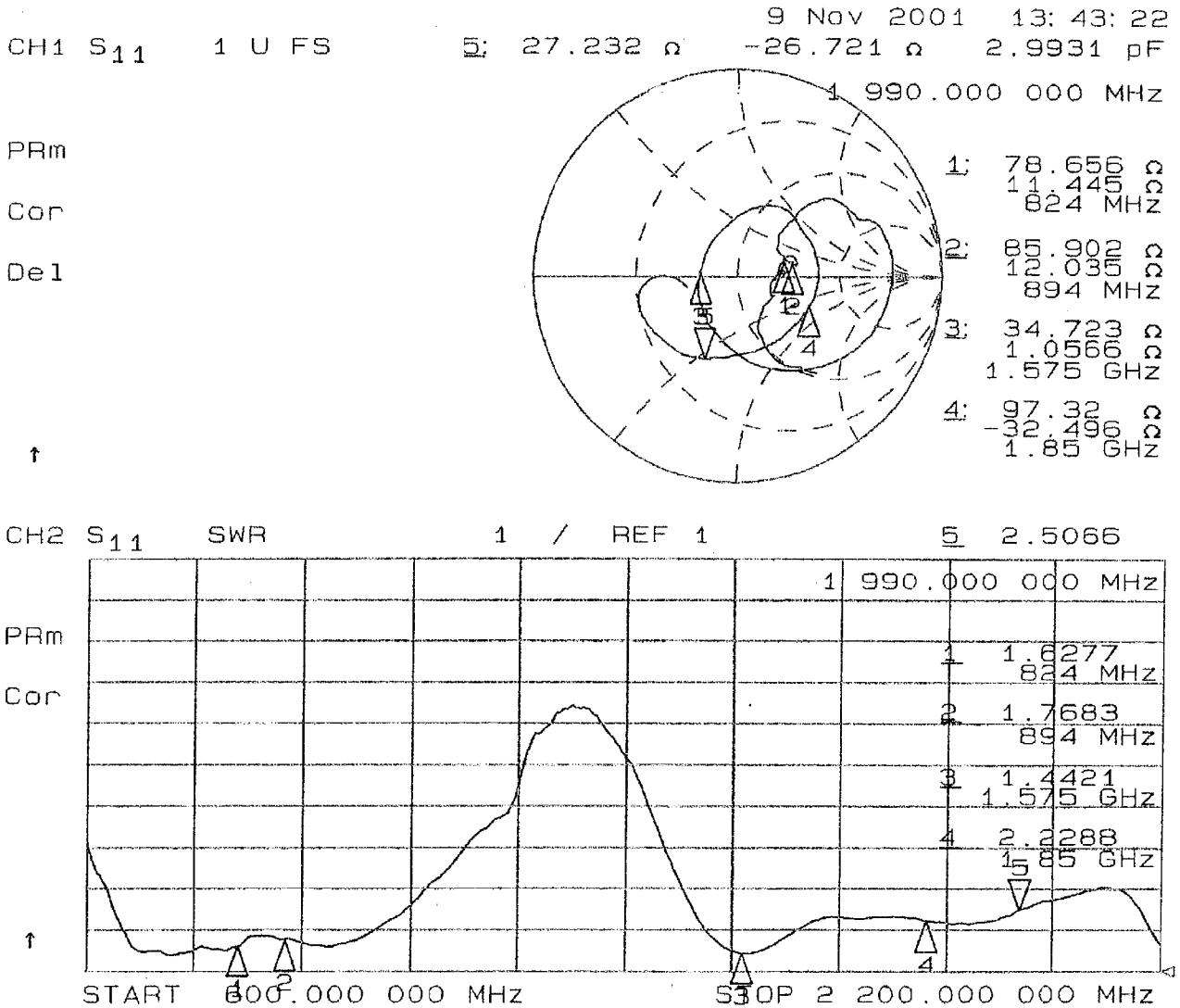
FIG. 13A is a frequency response chart which depicts the VSWR and impedance characteristics of the extended position of the multi-band retractable antenna of FIG. 11A with the meander antenna 30 of the embodiment of FIG. 3.
Figure 13B:
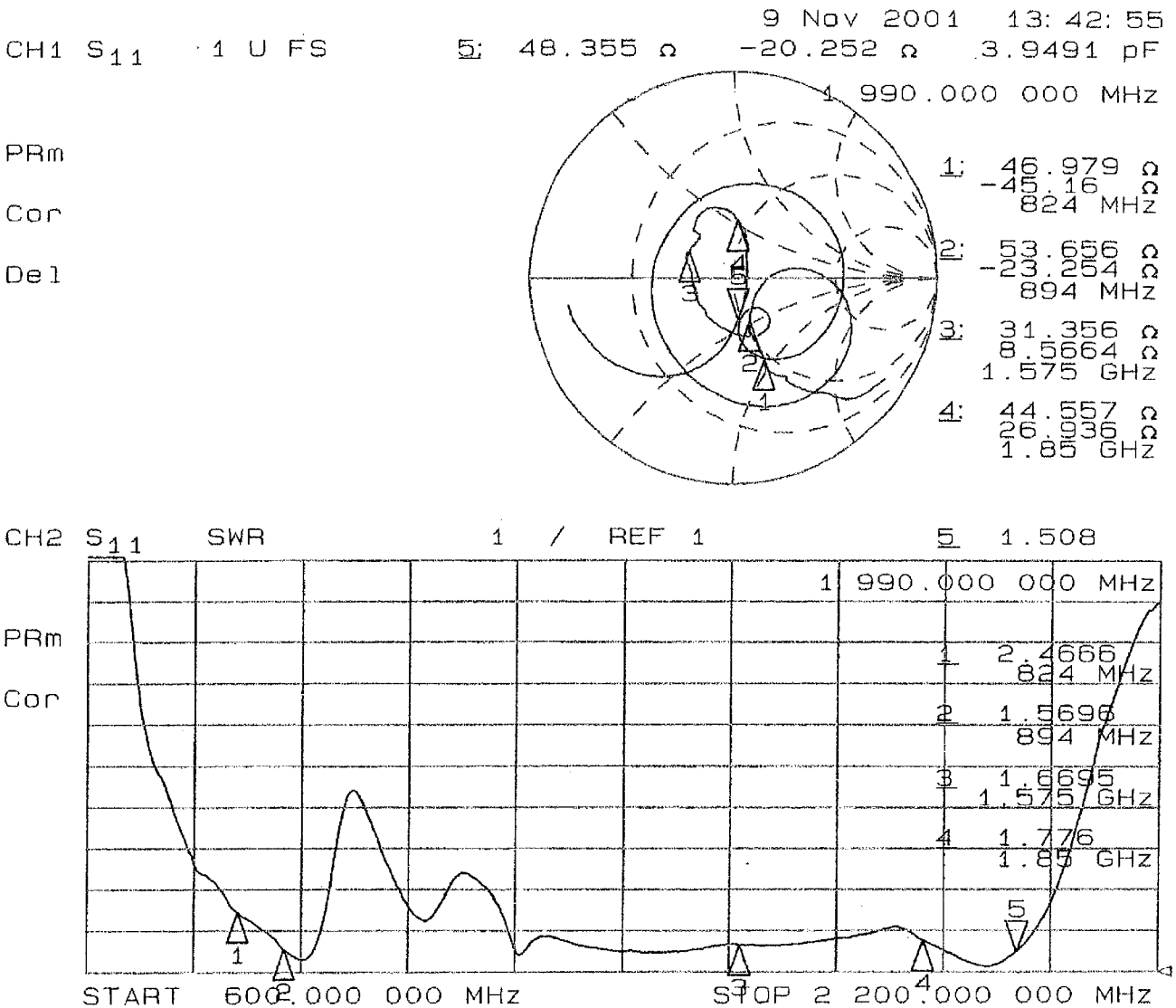
FIG. 13B is a frequency response chart which depicts the VSWR and impedance characteristics of the retracted position of the multi-band whip antenna of FIG. 11B with the meander antenna 30 of the embodiment of FIG. 3.

The analysis of the effect of the proximity of the point 28 either to loop 14 of the radiating element 11 (designed for resonant frequency of lower band) or to the loop 15 of the radiating element 12 (designed for resonant frequency of upper band) on the bandwidth characteristics of the multi-band retractable antenna (FIGS. 11A and 11B) is one of the objectives of this invention. To facilitate such a study, the results of the frequency response (VSWR and impedance) of the meander antenna 30 of the third embodiment (FIG. 3) of this invention configured along with a retractable whip antenna (as in FIGS. 11A and 11B) are shown in FIGS. 13A and 13B. FIG. 13A is the frequency response (VSWR and impedance) of the multi-band antenna (composite assembly of FIG. 11A consisting of the whip antenna 37 and the meander antenna 30 of the third embodiment [FIG. 3]) of this invention in its extended position. The corresponding frequency response (VSWR and impedance) of the above multi-band antenna in its retracted position (FIG. 11B) is shown in FIG. 13B. The satisfactory bandwidth performance of the proposed multi-band antenna for the tri-band operation covering the AMPS (cellular) for its lower band and the combined PCS (cellular) and GPS (non-cellular) for its upper band is substantiated by the results of the VSWR plots of FIGS. 13A and 13B. In meander antenna 30 (FIG. 3), the point 28 that connects the third element 27 to the adjacent elements 11 and 12 is relatively closer to the loop 14 of the radiating element 11 than the corresponding loop 15 of the radiating element 12. A comparison of the results of the VSWR plots of the FIGS. 12B and 13B reveals that the meander antenna 30 exhibits better bandwidth in its lower resonant band than the meander antenna 20. The above comparison highlights the importance of the location of the attachment of central element 27 with respect to the adjacent elements 11 and 12 in FIG. 3 of this invention for the improvement of the bandwidth of the multi-band antenna.

Figure 14A:
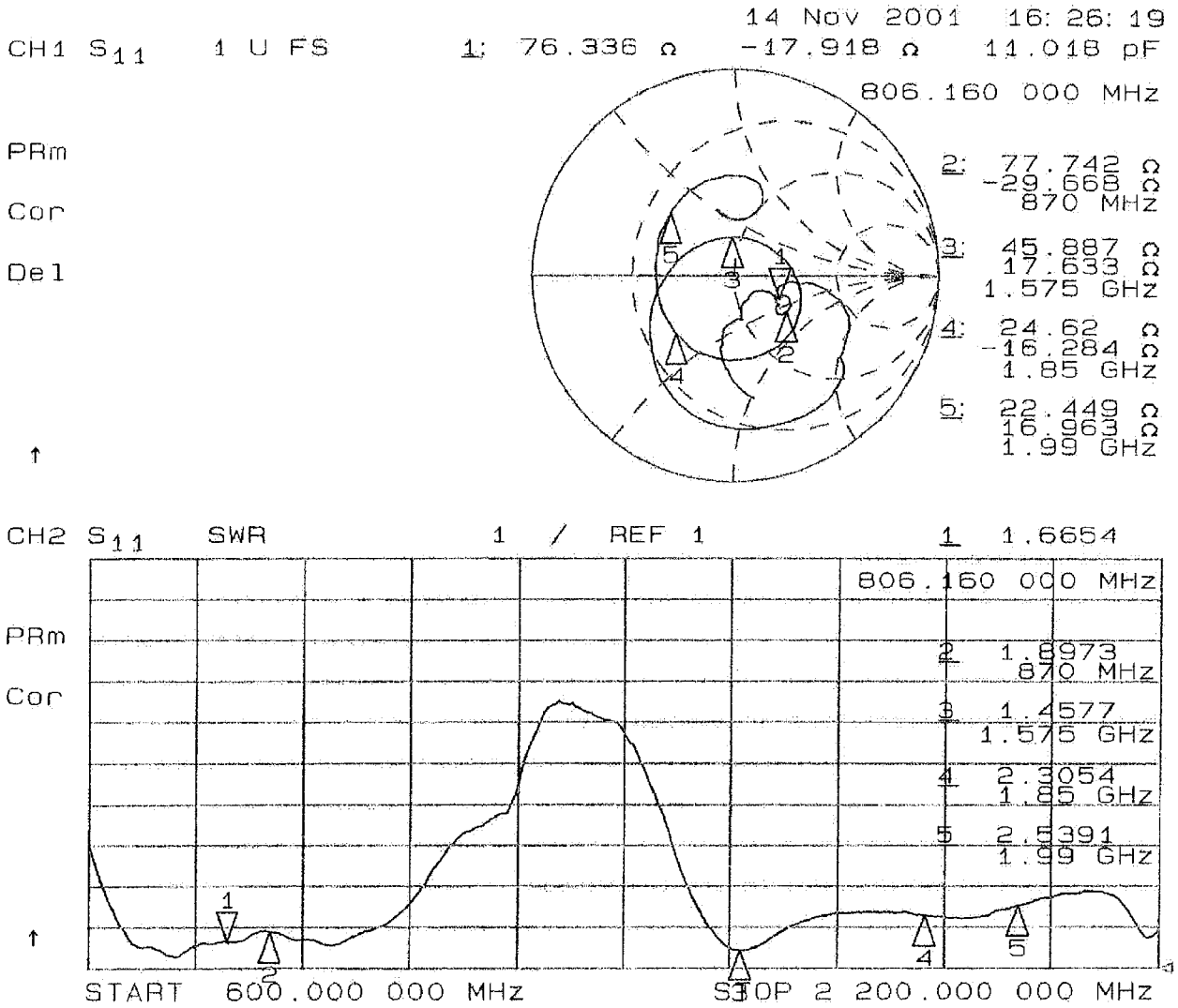
FIG. 14A is a frequency response chart which depicts the VSWR and impedance characteristics of the extended position of the multi-band retractable antenna of FIG. 11A with the meander antenna 40 of the embodiment of FIG. 4.
Figure 14B:
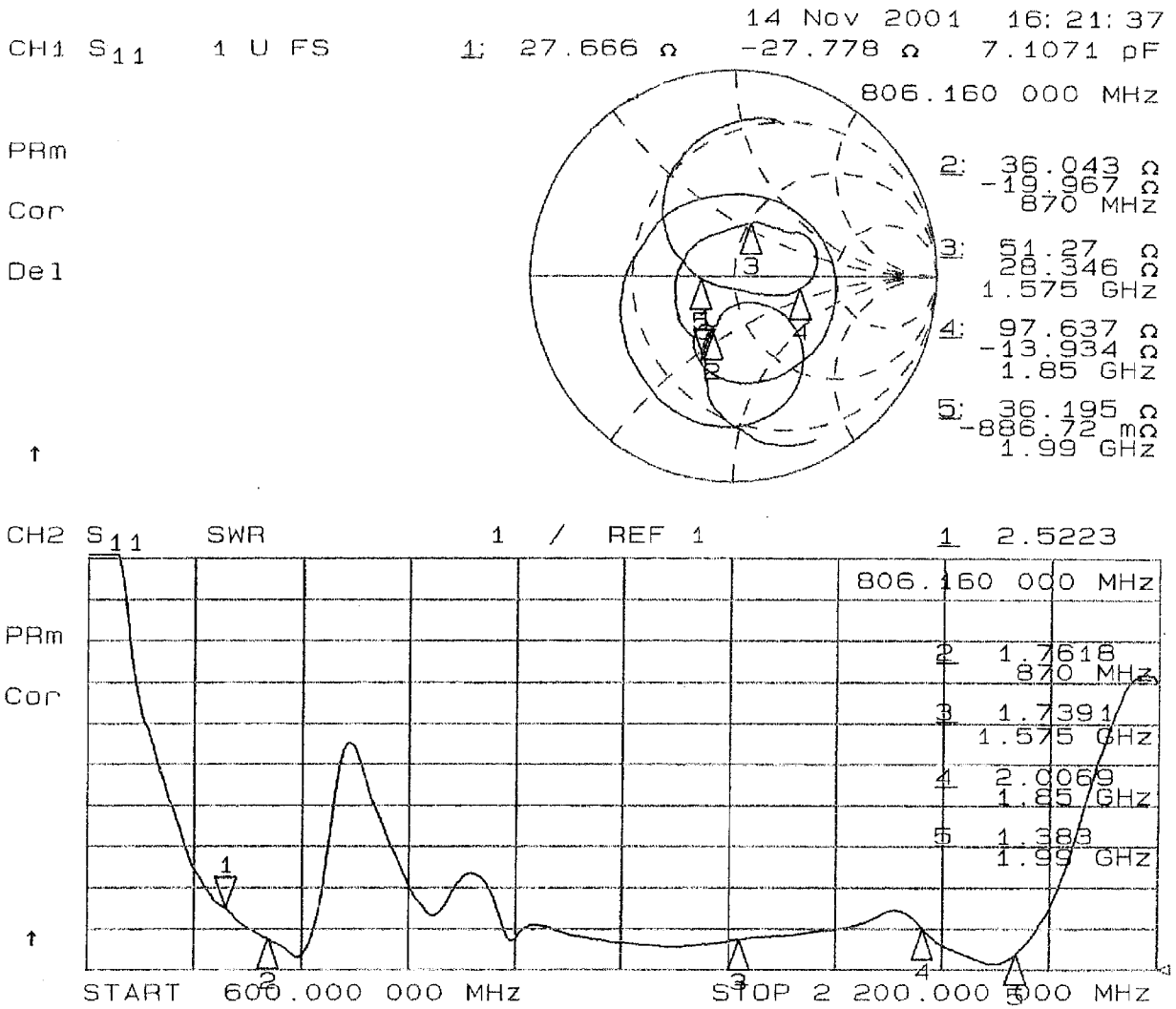
FIG. 14B is a frequency response chart which depicts the VSWR and impedance characteristics of the retracted position of the multi-band whip antenna of FIG. 11B with the meander antenna 40 of the embodiment of FIG. 4.

To ascertain the advantages of the choice of the active or passive nature of the central element on the bandwidth and radiation characteristics, the results of the frequency response (VSWR and impedance) of the meander antenna 40 of the fourth embodiment (FIG. 4) of this invention configured along with a retractable whip antenna (FIG. 11) are shown in FIGS. 14A and 14B. FIG. 14A shows the frequency response (VSWR and impedance) of the multi-band retractable antenna (composite assembly of FIG. 11A consisting of the whip antenna 37 and the meander antenna 40 of the fourth embodiment [FIG. 4]) of this invention in its extended position. The corresponding frequency response of the above multi-band antenna in its retracted position (FIG. 11B) is illustrated in FIG. 14B. From the results of the VSWR plots of the FIGS. 14A and 14B, it is seen that the proposed multi-band antenna has realized requisite bandwidth for the tri-band operation covering the AMPS (cellular) for its lower band and the combined PCS (cellular) and GPS (non-cellular) for its upper band. The central element 27 of the meander antenna 40 (FIG. 4) is designed as a passive radiator to serve as a parasitic to the other radiating elements 11 and 12. The central element 27 of the meander antenna 40 (FIG. 4) also has the coupling stubs 32 protruding into the loop 14 of the radiating element 11 primarily designed for the resonant frequency of the lower band. From the measured radiation patterns, it is concluded that the multi-band retractable antenna (FIGS. 11A and 11B) with a meander antenna 40 has a better cross-polarization performance than the corresponding multi-band retractable antenna with meander antenna 30. This suggests that the choice of the central radiator as an active element (as in FIG. 3) or as a passive element (as in FIG. 4) can also be one of the determining factors in the performance of the proposed multi-band retractable antenna.

Figure 15A:
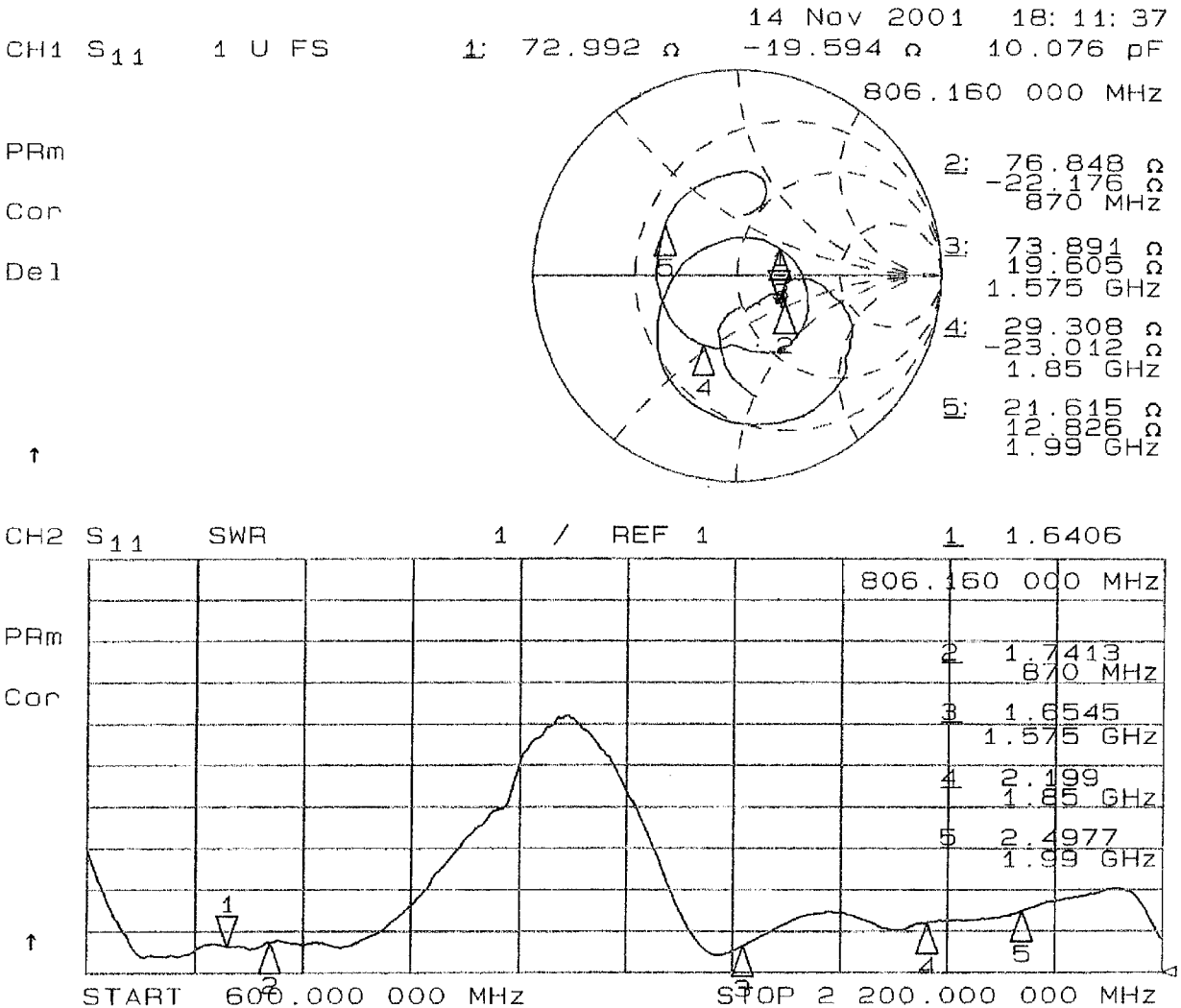
FIG. 15A is a frequency response chart which depicts the VSWR and impedance characteristics of the extended position of the multi-band retractable antenna of FIG. 11A with the meander antenna 50 of the embodiment of FIG. 5.
Figure 15B:
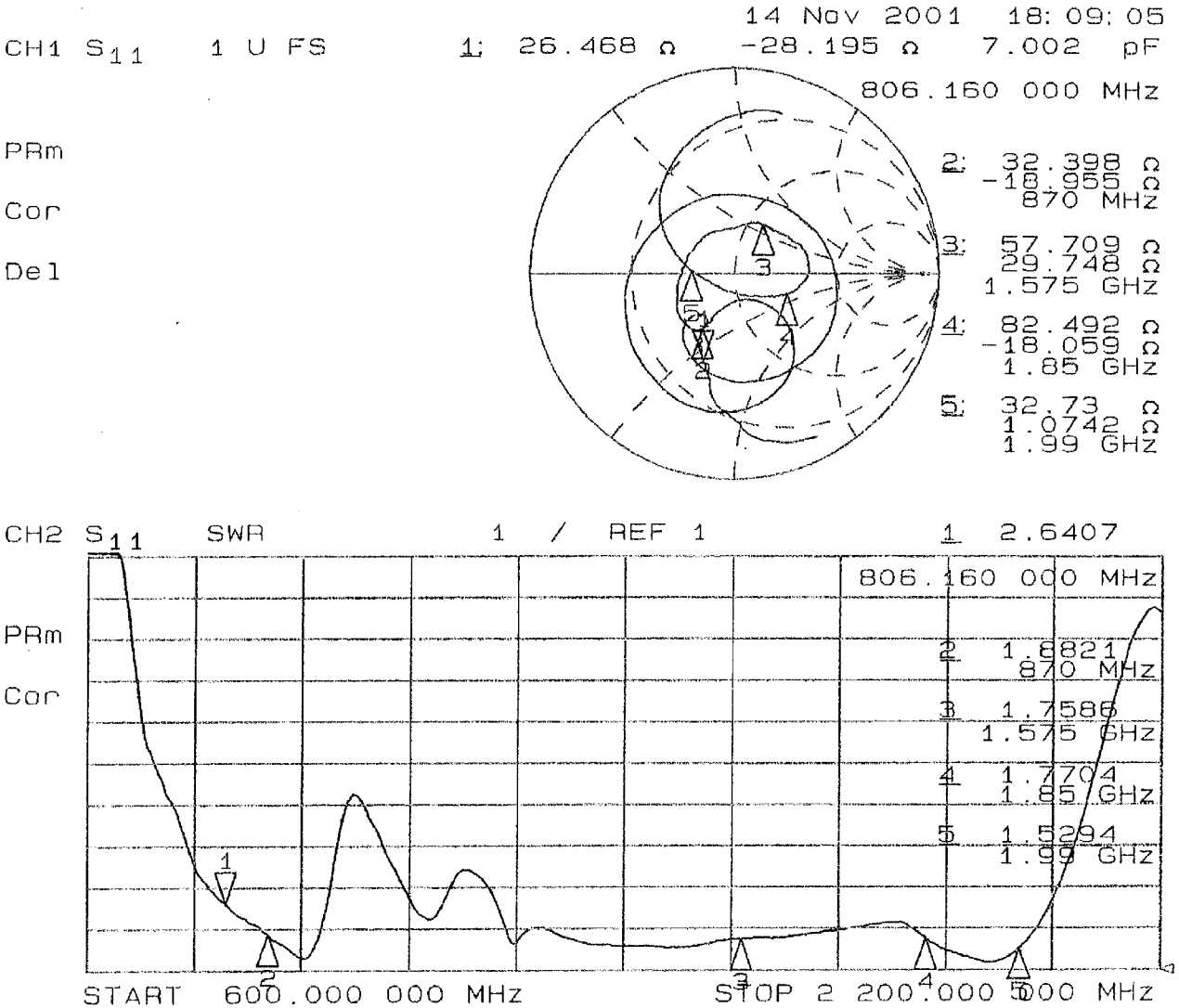
FIG. 15B is a frequency response chart which depicts the VSWR and impedance characteristics of the retracted position of the multi-band whip antenna of FIG. 11B with the meander antenna 50 of the embodiment of FIG. 5.

To illustrate the influence of the shape of the parasitic third (central) element 27 on the bandwidth and the radiation characteristics of the proposed multi-band antenna, the results of the frequency response (VSWR and impedance) of the meander antenna 50 of the fifth embodiment (FIG. 5) of this invention configured along with a retractable whip antenna (FIG. 11) are shown in FIG. 15. Unlike meander antenna 40 of FIG. 4, the meander antenna 50 (FIG. 5) of the fifth embodiment of this invention has its parasitic third element 27 of inverted L-shape. Like the meander antenna 40 (FIG. 4), the central element 27 of the meander antenna 50 (FIG. 5) also has the coupling stubs 32 protruding into the radiating element 11 primarily designed for the resonant frequency of the lower band. FIG. 15A depicts the frequency response (VSWR and impedance) of the multi-band retractable antenna (composite assembly of FIG. 11A consisting of the whip antenna 37 and the meander antenna 50 of the fifth embodiment [FIG. 5] of this invention) in its extended position. The corresponding frequency response of the above multi-band antenna in its retracted position (FIG. 11B) is illustrated in FIG. 15B. The good bandwidth of the proposed multi-band antenna for the tri-band operation covering the AMPS (cellular) for its lower band and the combined PCS (cellular) and GPS (non-cellular) for its upper band is revealed by the results of the VSWR plots of FIGS. 15A and 15B. A relative comparison of the corresponding VSWR responses of FIGS. 14A and 15A indicates that the multi-band retractable antenna consisting of a meander antenna 50 (with an inverted L-shape for the parasitic third element 27 as in FIG. 5) exhibits a better bandwidth performance than the multi-band retractable antenna with meander antenna 40 (FIG. 4) of this invention. This confirms that the suggested design technique of the meander antenna of this invention offers the additional degree of freedom to optimize and improve the bandwidth performance of the multi-band antenna for cellular communication applications. From the measured radiation patterns of. the multi-band retractable antenna (FIG. 11) with meander antenna 40 (FIG. 4) and meander antenna 50 (FIG. 5) of this invention, it is inferred that the multi-band antenna with meander antenna 50 (FIG. 5) of the fifth embodiment of this invention has a better cross-polarization performance than the corresponding multi-band antenna with meander antenna 40 (FIG. 4). This illustrates that the proposed design concept of meander antenna of this invention has the novel feature to control and optimize the cross-polar performance of the multi-band antenna. In cellular communication applications, the response of the antenna to both the vertical and horizontal polarization is of interest since the orientation of the antenna on cellular handset in "user" position is not always fixed. It is reasonable to assume that the cellular antenna with a better cross-polarization performance and still retaining good co-polar radiation characteristics is likely to enhance the overall performance of the cellular handset.

As can be seen from the above discussions and illustrations of the typical results of some of the embodiments of this invention, several novel schemes for the design of meander antennas of a multi-band retractable antenna for cellular communication applications have been developed and demonstrated. The embodiments of this invention propose the meander antenna of a single feed multi-band retractable antenna either with a combination of active elements or with a combination of active and passive elements. The design configurations of single feed multi-band meander antennas of this invention include two or three radiating elements. To fulfill the emerging demand of a single antenna for the cellular handset with multi-systems application capabilities, a greater thrust has been placed on the design of multi-band retractable antenna for tri-band operation comprising the AMPS (cellular) for lower band and the combined PCS (cellular) and GPS (non-cellular) for its upper band. This invention also assists in the realization of adequate bandwidth of the multi-band antenna comprising the whip and the multi-element meander antenna without resorting to either single or dual external impedance matching networks. This invention also proposes the new concept of the parasitic nature of the central element in the design of meander antenna of a multi-band retractable antenna. This invention also illustrates and demonstrates the novel concept of coupling stubs in the design of the meander antenna of a multi-band retractable antenna. The design considerations of the shape of the parasitic central element, the presence of the coupling stubs, the effect of proximity of the contact point of the central element to the adjacent radiating elements of the meander antennas of this invention offer the additional degrees of freedom to optimize the performance of the multi-band retractable antenna. The multi-band meander antennas of this invention configured with three elements have exhibited relatively wider bandwidth than the one configured with only two elements. The multi element meander antenna 10, the multi element meander antenna 20, the multi element meander antenna 30, the multi element meander antenna 40, the multi element meander antenna 50, the multi element meander antenna 60 and the multi element meander antenna 70 are compact and are amenable for large scale manufacturing. The design concept of the inner plastic cover and the RF connector as a single over-molded part has the advantage of fabrication ease and the desirable feature of simplified integration of the proposed multi-band retractable antenna to the actual system. This invention also proposes the design scheme to improve the cross-polar performance of the multi-band retractable antenna. The novel design schemes of the compact multi-band retractable antenna comprising the multi-element meander antennas (with active and passive elements/with and without coupling) of this invention have accomplished all of its stated objectives.

We claim:

1. In combination with a wireless communication device including a housing having upper and lower ends, and a transceiver circuit disposed within the housing, comprising: a retractable antenna mounted on said housing and being movable between a retracted position and an extended position; a multi-band meander antenna mounted on said housing; said meander antenna comprising:

(a) a flexible dielectric substrate having upper and lower ends;

(b) first and second meander radiating elements, having upper and lower ends, formed on said substrate which are positioned between the said upper and lower ends thereof;

(c) said first and second meander radiating elements including a plurality of alternating loops with each loop thereof having open and closed ends;

(d) said first meander radiating element resonating at a lower frequency band;

(e) said second meander radiating element resonating at a higher frequency band;

(f) at least some of the closed ends of said loops of said second meander radiating element protruding into said open ends of said loops of said first meander radiating element thereby resulting in a selective coupling between said first and second meander radiating elements.

2. The combination of claim 1 wherein said meander antenna is generally cylindrical in shape and is positioned within a cylindrical housing mounted on the upper end of said housing.

3. The combination of claim 2 wherein said retractable antenna selectively movably extends through said meander antenna and said cylindrical housing.

4. The combination of claim 2 wherein said substrate is positioned on a hollow, cylindrical dielectric member.

5. The combination of claim 1 wherein a feed line connects said lower ends of said first and second meander radiating elements, said feed line having upper and lower ends.

6. The combination of claim 5 wherein a ring-shaped feed tab is provided at the lower end of said feed line to serve as a common feed to both of said first and second meander radiating elements.

7. The combination of claim 6 wherein said first and second meander radiating elements, said feed line and said feed tab are of integral construction.

8. The combination of claim 1 wherein said closed ends of said loops of said second meander radiating element have a tapered cross-section.

9. In combination with a wireless communication device including a housing having upper and lower ends, and a transceiver circuit disposed within the housing, comprising: a retractable antenna mounted on said housing and being movable between a retracted position and an extended position; and a multi-band meander antenna mounted on said housing; said meander antenna comprising:

(a) a flexible dielectric substrate having upper and lower ends;

(b) first and second meander radiating elements, having upper and lower ends, formed on said substrate which are positioned between the said upper and lower ends thereof;

(c) said first and second meander radiating elements including a plurality of alternating loops with each loop thereof having open and closed ends;

(d) said first meander radiating element resonating at a lower frequency band;

(e) said second meander radiating element resonating at a higher frequency band;

(f) a third, generally elongated radiating element formed on said substrate between said first and second meander radiating elements and having upper and lower ends;

(g) said third radiating element resonating in a frequency near the frequency of said higher frequency band;

(h) a feed line electrically connecting said lower ends of said first and second meander radiating elements.

10. The combination of claim 9 wherein said third radiating element has spaced-apart protrusions formed thereon which extend into said open ends of said loops of said first meander radiating element.

11. The combination of claim 10 wherein said protrusions are triangular in shape.

12. The combination of claim 12 wherein a ring-shaped feed tab is electrically connected to said feed line.

13. The combination of claim 10 wherein a ring-shaped feed tab is electrically connected to said feed line.

14. The combination of claim 9 wherein said lower end of said third radiating element is electrically connected to said feed line.

15. The combination of claim 14 wherein a ring-shaped feed tab is electrically connected to said feed line.

16. The combination of claim 9 wherein said upper end of said third radiating element has a laterally extending portion formed therewith so that said third radiating element defines a generally, inverted L-shape.

17. The combination of claim 16 wherein said third radiating element has spaced-apart protrusions formed thereon which extend into said open ends of said loops of said first meander radiating element.

18. The combination of claim 16 wherein a ring-shaped feed tab is electrically connected to said feed line.

19. The combination of claim 9 wherein said third radiating element defines a generally, inverted U-shape.

20. The combination of claim 19 wherein a ring-shaped feed tab is electrically connected to said feed line.

21. The combination of claim 9 wherein said third radiating element defines a generally, inverted U-shape including a pair of legs, one of which is electrically connected to said feed line.

22. The combination of claim 21 wherein a ring-shaped feed tab is electrically connected to said feed line.

23. The combination of claim 21 wherein said one leg of said third radiating element has a plurality of spaced-apart protrusions formed thereon which extend into said open ends of said loops of said first meander radiating element.

24. The combination of claim 9 wherein said loops of said first meander radiating element are generally rectangular in shape.

25. The combination of claim 24 wherein said loops of said second meander radiating element are generally rectangular in shape.

26. The combination of claim 9 wherein said loops of said second meander radiating element are generally rectangular in shape.

27. The combination of claim 9 wherein said third radiating element includes first and second leg portions joined by a connecting portion to define an inverted, generally U-shape, said first leg portion having a plurality of spaced-apart protrusions formed thereon which extend into said open ends of said loops of said first meander radiating element.

28. The combination of claim 9 wherein said third radiating element defines a generally, inverted U-shape including a pair of legs.

29. The combination of claim 28 wherein one of said legs of said third radiating element has a plurality of spaced-apart protrusions formed thereon which extend into said open ends of said loops of said meander radiating element.

30. The combination of claim 28 wherein said legs of said third radiating element are free from mechanical connection to said first and second radiating elements.

31. An antenna system for a wireless communication device including a housing, having upper and lower ends, and a transceiver circuit disposed within the housing, comprising:

an RF connector having upper and lower ends;

said RF connector having means thereon for connection to the transceiver circuit when the antenna system is mounted on the wireless communication device;

said RF connector having an enlarged diameter portion formed thereon between its upper and lower ends defining an annular shoulder;

a first generally cylindrical, hollow plastic housing member having upper and lower ends;

said lower end of said first housing member embracing said upper end of said RF connector above said shoulder;

a hollow, generally cylindrical dielectric spacer positioned within the interior of said first housing member;

a flexible dielectric substrate wrapped around said dielectric spacer;

said substrate having inner and outer surfaces;

a meander radiator formed on said outer surface of said substrate which is electrically connected to said RF connector;

a second generally cylindrical plastic housing member embracing said first housing member;

and a retractable whip antenna movably mounted in said wireless communication device housing and said dielectric spacer;

said whip antenna being movable between retracted and extended positions.

32. The combination of claim 31 wherein said meander radiator comprises:

(a) first and second meander radiating elements, having upper and lower ends, formed on said substrate which are positioned between the said upper and lower ends thereof;

(b) said first and second meander radiating elements including a plurality of alternating loops with each loop thereof having open and closed ends;

(c) said first meander radiating element resonating at a lower frequency band;

(d) said second meander radiating element resonating at a higher frequency band;

(e) at least some of the closed ends of said loops of said second meander radiating element protruding into said open ends of said loops of said first meander radiating element thereby resulting in a selective coupling between said first and second meander radiating elements.

33. The combination of claim 32 wherein a feed line connects said lower ends of said first and second meander radiating elements, said feed line having upper and lower ends.

34. The combination of claim 33 wherein a ring-shaped feed tab is provided at the lower end of said feed line to serve as a common feed to both of said first and second meander radiating elements; said feed tab being in electrical engagement with said RF connector.

35. The combination of claim 34 wherein said ring-shaped feed tab is positioned on the upper end of said RF connector.

36. The combination of claim 33 wherein said closed ends of said loops of said second meander radiating element have a tapered cross-section.

37. The combination of claim 34 wherein said first and second meander radiating elements, said feed line and said feed tab are of integral construction.

38. In combination with a wireless communication device including a housing having upper and lower ends, and a transceiver circuit disposed within the housing, comprising: a retractable antenna mounted on said housing and being movable between a retracted position and an extended position; a multi-band meander antenna mounted on said housing; said meander antenna comprising:

(a) a flexible dielectric substrate having upper and lower ends;

(b) first and second meander radiating elements, having upper and lower ends, formed on said substrate which are positioned between the said upper and lower ends thereof;

(c) said first and second meander radiating elements including a plurality of alternating loops with each loop thereof having open and closed ends;

(d) said first meander radiating element resonating at a lower frequency band;

(e) said second meander radiating element resonating at a higher frequency band;

(f) a third, generally elongated radiating element formed on said substrate between said first and second meander radiating elements and having upper and lower ends;

(g) said third radiating element resonating in a frequency near the frequency of said higher frequency band;

(h) a feed line electrically connecting said lower ends of said first and second meander radiating elements said feed line being electrically connected to an RF connector.

39. The combination of claim 38 wherein said third radiating element has spaced-apart protrusions formed thereon which extend into said open ends of said loops of said first meander radiating element.

40. The combination of claim 39 wherein said protrusions are triangular in shape.

41. The combination of claim 40 wherein a ring-shaped feed tab is electrically connected to said feed line.

42. The combination of claim 39 wherein a ring-shaped feed tab is electrically connected to said feed line.

43. The combination of claim 38 wherein said lower end of said third radiating element is electrically connected to said feed line.

44. The combination of claim 43 wherein a ring-shaped feed tab is electrically connected to said feed line.

45. The combination of claim 38 wherein said upper end of said third radiating element has a laterally extending portion formed therewith so that said third radiating element defines a generally, inverted L-shape.

46. The combination of claim 45 wherein said third radiating element has spaced-apart protrusions formed thereon which extend into said open ends of said loops of said first meander radiating element.

47. The combination of claim 45 wherein a ring-shaped feed tab is electrically connected to said feed line.

48. The combination of claim 38 wherein said third radiating element defines a generally, inverted U-shape.

49. The combination of claim 48 wherein a ring-shaped feed tab is electrically connected to said feed line.

50. The combination of claim 38 wherein said third radiating element defines a generally, inverted U-shape including a pair of legs, one of which is electrically connected to said feed line.

51. The combination of claim 50 wherein a ring-shaped feed tab is electrically connected to said feed line.

52. The combination of claim 50 wherein said one leg of said third radiating element has a plurality of spaced-apart protrusions formed thereon which extend into said open ends of said loops of said first meander radiating element.

53. The combination of claim 38 wherein said loops of said first meander radiating element are generally rectangular in shape.

54. The combination of claim 53 wherein said loops of said second meander radiating element are generally rectangular in shape.

55. The combination of claim 38 wherein said loops of said second meander radiating element are generally rectangular in shape.

56. The combination of claim 38 wherein said third radiating element includes first and second leg portions joined by a connecting portion to define an inverted, generally U-shape, said first leg portion having a plurality of spaced-apart protrusions formed thereon which extend into said open ends of said loops of said first meander radiating element.

57. The combination of claim 38 wherein said third radiating element defines a generally, inverted U-shape including a pair of legs.

58. The combination of claim 57 wherein one of said legs of said third radiating element has a plurality of spaced-apart protrusions formed thereon which extend into said open ends of said loops of said meander radiating element.

59. The combination of claim 57 wherein said legs of said third radiating element are free from mechanical connection to said first and second radiating elements.

* * * * *